US006324357B1

(12) United States Patent
Gomi et al.

(10) Patent No.: US 6,324,357 B1
(45) Date of Patent: Nov. 27, 2001

(54) IMAGE FORMING APPARATUS CAPABLE OF PROPERLY CONTROLLING AC VOLTAGE APPLIED TO A CHARGER

(75) Inventors: Fumiteru Gomi, Shizuoka-ken; Kouichi Hashimoto, Numazu; Yoshiyuki Komiya, Mishima, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/604,740

(22) Filed: Jun. 28, 2000

(30) Foreign Application Priority Data

Jun. 29, 1999 (JP) ..... 11-183730
Jun. 29, 1999 (JP) ..... 11-183731

(51) Int. Cl.[7] ..... G03G 15/02; G03G 15/00
(52) U.S. Cl. ..... 399/50; 399/43; 399/175
(58) Field of Search ..... 399/50, 24, 25, 399/168, 174, 175, 176, 43

(56) References Cited

U.S. PATENT DOCUMENTS 4,771,313 * 9/1988 Kuroda et al. ..... 399/25
5,548,374 * 8/1996 Iguchi et al. ..... 399/24
5,740,500 4/1998 Hashimoto ..... 399/114
5,749,022 * 5/1998 Kikui et al. ..... 399/50
5,754,926 * 5/1998 Sakuraba et al. ..... 399/175
5,923,924 7/1999 Hashimioto ..... 399/111
5,970,285 * 10/1999 Ito et al. ..... 399/175 X
6,016,408 1/2000 Hashimoto ..... 399/27
6,044,235 3/2000 Hashimoto ..... 399/99
6,101,352 4/2000 Hashimoto ..... 399/119

FOREIGN PATENT DOCUMENTS 7-281564 * 10/1995 (JP) .
9-190143 * 7/1997 (JP) .

* cited by examiner

*Primary Examiner*—Susan S.Y. Lee
(74) *Attorney, Agent, or Firm*—Fitzpatrick, Cella, Harper & Scinto

(57) ABSTRACT

An image forming apparatus includes an image bearing member for bearing a toner image; a transfer device for transferring the toner image onto a transfer material from the image bearing member; a charger for electrically charging the image bearing member, the charger being contactable to residual toner remaining on the image bearing member after transfer of the toner image by the transfer device; a voltage applicator for applying DC and AC voltages to the charger; an image forming device for forming an electrostatic image on the image bearing member charged by the charger; a developing device for developing the electrostatic image by toner; an integrator for integrating degree of usage of the apparatus; and a controller for controlling the AC voltage applied to the charger in accordance with the integrated degree of usage provided by the integrator.

15 Claims, 14 Drawing Sheets

IMAGE FORMING APPARATUS CAPABLE OF PROPERLY CONTROLLING AC VOLTAGE APPLIED TO A CHARGER

FIELD OF THE INVENTION AND RELATED ART

The present invention relates to an image forming apparatus such as a copying machine, a printer, or the like, which employs an electrophotographic or electrostatic recording method. It also relates to a process cartridge removably installable in such an image forming apparatus.

In recent years, an image forming apparatus has been progressively reduced in size, and there has appeared a cleaner-less image forming apparatus, which lacks a cleaner as a cleaning means for removing residue, such as the toner which remains on the peripheral surface of the photosensitive drum after image transfer. In the case of a cleaner-less image forming apparatus, the cleaning is done by a developing apparatus at the same time and place as developing is done (development-recovery).

The term "development-cleaning" method fog-removal bias, during the following development processes. According to this method, the transfer residual toner is recovered to be used in the following image formation processes, and no waste toner is produced, making it possible to reduce the annoying time and effort required for maintenance. Further, it is advantageous in terms of space; in other words, elimination of a cleaner makes it possible to drastically reduce the size of an image forming apparatus.

Regarding a charging means for charging an object, for example, the aforementioned photosensitive drum, to predetermined polarity and potential level, a contact charging apparatus (contact charging device) has been put to practical use because of its advantage of being smaller in ozone production, power consumption, and the like. A contact charging apparatus is a charging apparatus which charges an object by placing a charging member (contact charging member), to which voltage is being applied, in contact with the object.

As a typical contact charging apparatus, a magnetic brush type contact charging apparatus (magnetic brush type charging device) comes to mind. A magnetic brush type contact charging apparatus employs a magnetic brush as a contact charging member. A magnetic brush is formed by magnetically confining electrically conductive magnetic particles directly on a magnet, or on a sleeve which contains a magnet. It is placed in contact with an object, while being held stationary or being rotated. The object begins to be charged as voltage is applied to the magnetic brush.

There are contact charging members other than a magnetic type contact charging member. For example, a brush formed by shaping a bundle of electrically conductive fiber into the form of a brush (fur brush), and an electrically conductive rubber roller formed by shaping electrically conductive rubber into the form of a roller (charge roller), are also used as a preferable contact charging member.

When a magnetic brush type contact charging apparatus is used to charge a photosensitive member formed by placing on an ordinary organic photosensitive member, a surface layer (charge injection layer) in which electrically conductive microscopic particles are dispersed, or a photosensitive member based on amorphous silicon, it is possible to give the photosensitive member a surface potential level approximately equal to the potential level of the DC component of the bias applied to the magnetic brush. This type of charging method is called "charge injection". This charge injection based on a magnetic brush does not rely on electrical discharge on which a corona type charging device relies, to charge an object. Therefore, the usage of this magnetic based charge injection makes it possible to charge an object without producing any amount of ozone, and also to reduce the amount of power consumption. Thus, a magnetic brush based charge injection has recently been attracting attention.

Further using toner excelling in the mold releasing property, for example, toner manufactured by polymerization, is very effective to improve the efficiency of the development-cleaning process.

The aforementioned cleaner-less system does not require a waste toner container, and therefore, when it is employed by an image forming apparatus which employs a process cartridge system, it is possible to extend the service life of the image forming apparatus, although the actual length of the service life depends on the durability of the components other than those for a cleaning device. To summarize, incorporation of a cleaner-less system into an image forming apparatus makes it possible to realize an image forming apparatus which is smaller in size and running cost, and produces no ozone.

However, in the case of an image forming apparatus which employs a contact charging apparatus as a charging means for charging an image bearing member such as a photosensitive member, as image formation is repeated, toner particles as developer mix into the contact charging member from the surface of the image bearing member, thereby contaminating the contact charging member. As a result, the performance of the contact charging member is sometimes compromised in consistency.

This problem is particularly conspicuous in a cleaner-less system, such as a cleaner-less image forming apparatus which lacks a cleaning apparatus for removing the transfer residual toner from the image bearing member, and in which the transfer residual toner mixes into the contact charging member by a relatively large amount.

The transfer residual toner on the image forming apparatus preserves the pattern of the preceding image virtually as it was. Therefore, if the portion of the peripheral surface of the photosensitive drum, where the transfer residual toner is present, is passed through the charging portion (charging area), that is, the interface between the contact charging member and image bearing member, while the transfer residual toner remains undisturbed, problems occur. For example, the potential level of the photosensitive drum is reduced across the area covered with the transfer residual toner, or the transfer residual toner blocks the exposure light during the following image forming rotational cycles of the photosensitive drum. As a result, the following image formation step, that is, the development step, is affected; during the following image forming rotational cycles of the photosensitive drum, the image is formed lighter or darker, across the portions corresponding to where the transfer residual toner is. In other words, a ghost is created.

As a countermeasure for the formation of a ghost, it has been proposed to employ a leveling member in the form of a brush for evenly distributing the transfer residual toner which preserves the pattern of the preceding image, across the peripheral surface of the photosensitive drum, or to employ a simplified cleaning member which temporarily relies on the effects of bias.

In the case of the contact charging, there is a bias condition under which the toner, which has mixed into, or adhered to, a contact charging member, can be easily ejected out onto the photosensitive drum. Thus, the service life of a contact charging member can be extended with the provision of an operational mode in which toner is ejected from the contact charging member using this bias condition.

However, the aforementioned bias condition favorable for toner ejection does not necessarily coexist with a condition favorable for charging. Further, it is possible that regularly running a long sequence of forcefully ejecting toner may result in the consumption of an unnecessary amount of time. In addition, in the case of a simply structured image forming apparatus which does not have any means for detecting the state of a contact charging means in terms of the deterioration resulting from usage, it is difficult to eject toner effectively in a short time, while maintaining satisfactory image quality.

For example, even if a case in which a relatively small number of prints with a high image ratio are produced in a relatively short period, and a case in which a relatively large number of prints with a low image ratio are produced in a relatively long period, are equal in the amount of toner consumption and the cumulative amount of the transfer residual toner which mixes into a contact charging member in a relatively long period, the two cases are different in the cumulative length of the post-rotation period during which the mixed toner is ejected. Therefore, the two cases are different in the amount of the toner which ultimately remains in the contact charging member. In other words, in reality, the charging performance of a contact charging member varies depending on the condition under which it is used. Thus, it is impossible to determine the state of a contact charging member in terms of performance deterioration, solely based on information regarding the amount of toner consumption. Therefore, the degree of the deterioration of a contact charging member in terms of charging performance must be synthetically determined based on the total amounts of toner consumption, ejection time, and the like, and necessary control must be executed based on the thus obtained results.

SUMMARY OF THE INVENTION

The primary object of the present invention is to provide an image forming apparatus which prevents its contact charging member from deteriorating due to the contamination by toner.

Another object of the present invention is to provide an image forming apparatus capable of efficiently ejecting toner from its contact charging member.

According to one of the aspects of the present invention, an image forming apparatus comprises: an image bearing member for bearing a toner image transferring means for transferring the toner image on the image bearing member onto transfer medium; charging means for charging the image bearing member by being placed in contact with the toner remaining on the image bearing member after the toner image transfer by the transferring means; voltage applying means for applying DC voltage and AC voltage to said charging means; image forming means for forming an electrostatic image on the image bearing member charged by the charging means; developing means for developing the electrostatic image with the use of toner; accumulating means for accumulating the amount of the apparatus usage; and controlling means for controlling the AC voltage applied to said charging means based on the cumulative amount of apparatus usage accumulated by said accumulating means.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the preferred embodiments of the present invention will be described with reference to FIGS. 1–7.

Figure 1:
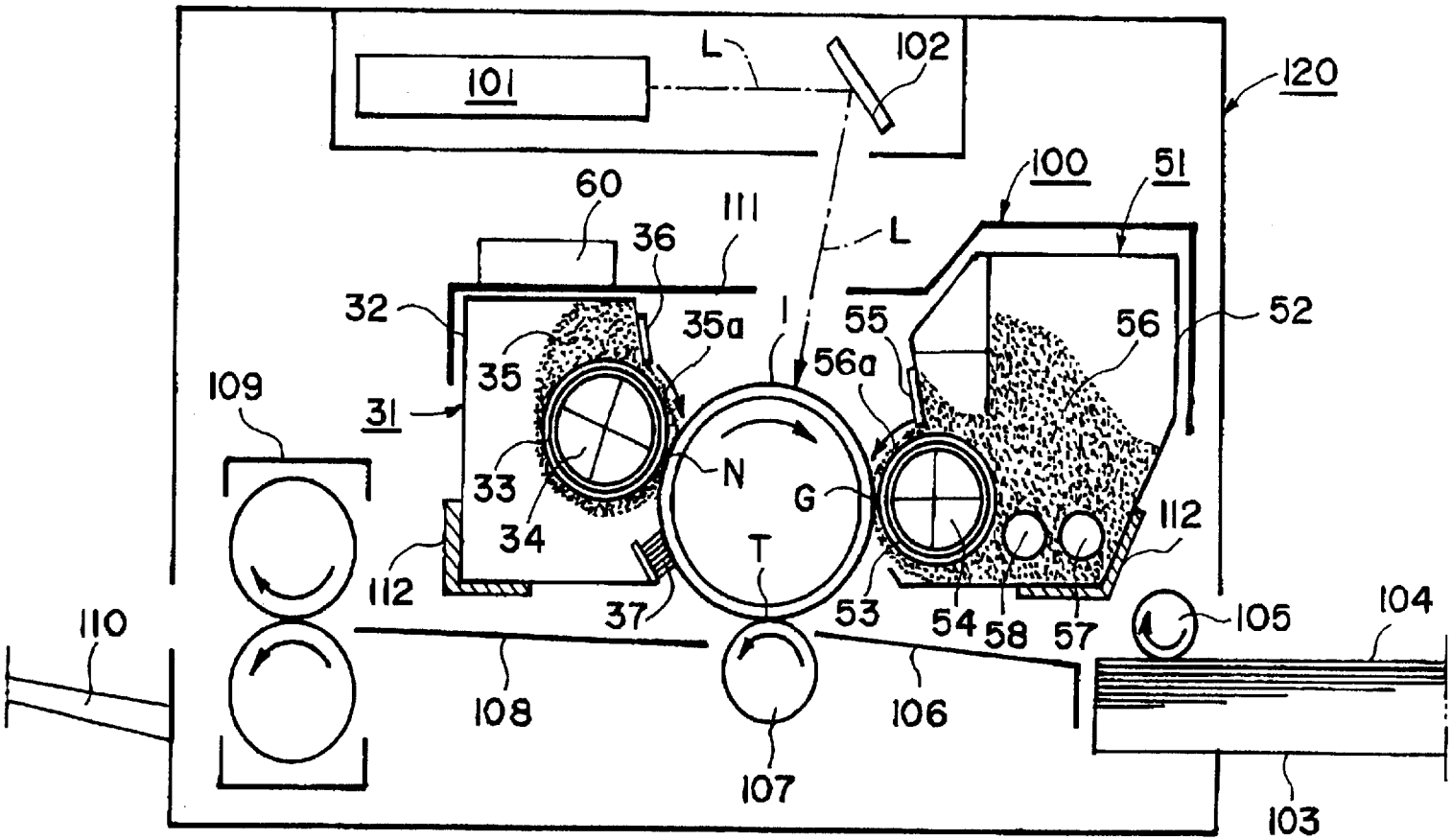
FIG. 1 is a schematic sectional view of the image forming apparatus in the first embodiment of the present invention, and depicts the general structure of the apparatus.

FIG. 1 is a schematic sectional view of an example of an image forming apparatus in accordance with the present invention, and describes the general structure of the apparatus.

The image forming apparatus in this embodiment is a laser beam printer which employs a transfer type electrophotographic process, a contact charging system based on a magnetic brush, a reversal developing method, a cleaner-less system, and a process cartridge removably installable in the image assembly of the image forming apparatus.

A reference numeral 1 designates an electrophotographic photosensitive member (photosensitive drum) in the form of a rotatable drum, as an image bearing member. This photosensitive drum 1 is rotationally driven about its axial line in the clockwise direction indicated by an arrow mark at a predetermined peripheral velocity. The photosensitive drum 1 in this embodiment is an organic photosensitive member and is chargeable to negative polarity by charge injection. It is approximately 30 mm in diameter, and is rotationally driven at a peripheral velocity of 100 mm/sec.

a. charging: the peripheral surface of the photosensitive drum 1 is uniformly charged (primary charge) to predetermined polarity and potential level by a contact charging apparatus 31 based on a magnetic brush (charging unit based on magnetic brush, charging device based on magnetic brush, charge injection device based on magnetic brush) as a contact charging means, while being rotated. The magnetic brush based contact charging apparatus 31 will be described later.

b. image exposure: the uniformly charged peripheral surface of the photosensitive drum 1 is exposed by a scanner unit 101 (it is exposed to a scanning beam of the light modulated with image formation), while being rotated. As a result, an electrostatic latent image is formed on the rotating photosensitive drum 1 in a continuous fashion.

More specifically, a laser beam L modulated with image signals is outputted from the scanner unit 101 comprising a laser (optical information light source), a polygon mirror, a correctional lens system, and the like. This laser beam is deflected by a reflection mirror 102 toward the peripheral surface of the photosensitive drum 1, so that the peripheral surface of the photosensitive drum 1 is scanned in the primary direction by the laser beam L. Since the photosensitive drum 1 is being rotated, the peripheral surface of the photosensitive drum 1 is scanned by this laser beam L also in the secondary direction. As a result, the potential level of the peripheral surface of the photosensitive drum 1, which is uniform prior to the scanning, changes across the scanned area; the potential level falls across the portions exposed by the laser beam L (light portion potential level), creating a contrast in potential level between the exposed portions and the unexposed portions (dark portion potential). As a result, an electrostatic latent image which reflects the exposure pattern is formed.

c. development: the electrostatic latent image formed on the peripheral surface of the rotating photosensitive drum 1 is developed into a toner image by a developing apparatus 51 (development unit) as a developing means. This developing apparatus 51, which in the case of this embodiment develops the latent image in reverse, will be described later.

d. transfer; meanwhile, a plurality of sheets of recording medium 103 (transfer medium) stored in a sheet feeder cassette 104 are supplied one by one by a sheet feeder roller 105 in synchronism with the latent image formation on the photosensitive drum 1. The recording sheet 104 is delivered to a transfer portion T, which is the contact nip between a transfer roller 107 as a transferring means and the photosensitive drum 1, by a conveying means 101, in synchronism with the arrival of the leading end of the toner image on the photosensitive drum 1 at the transfer portion T. In the transfer portion T, the toner image on the peripheral surface of the photosensitive drum 1 is electrostatically transferred onto the surface of the recording sheet 104. More specifically, at the same time as the leading end of the recording sheet 104 enters the transfer portion T, a predetermined transfer bias begins to be applied to the transfer roller 107 from an unillustrated transfer bias application power source, to charge the recording sheet 104 to the polarity opposite to the toner polarity, from the back side of the recording sheet 104. As a result, the toner image on the photosensitive drum 1 is continuously transferred onto the top side of the recording sheet 104, starting from the leading end.

e. fixation: after coming out of the transfer nip portion T, the recording sheet 104 is separated from the peripheral surface of the photosensitive drum 1, and is conveyed to, and introduced into, a fixing apparatus 109 (fixing device), which employs a thermal fixation system, which is a system generally used, through a conveying means 108. In the fixing apparatus 109, the toner image is fixed as a permanent image. Thereafter, the recording sheet 104 is discharged as a copy or a print into a delivery tray 110.

f. cleaner-less system: the toner remaining on the photosensitive drum 1 after the toner image transfer reaches a charging portion N, as the photosensitive drum 1 is further rotated. In the charging portion N, this transfer residual toner is temporarily recovered by a magnetic brush based contact charging apparatus 31, and then, is evenly ejected back onto the peripheral surface of the photosensitive drum 1. Then, the transfer residual toner evenly distributed on the peripheral surface of the photosensitive drum 1 reaches a developing portion G as the photosensitive drum 1 is further rotated. In the developing portion G, the transfer residual toner is recovered into the developing apparatus 51 by the reversal bias for development, at the same time as the latent image is developed. This cleaner-less system will be further described later.

A reference numeral 100 designates a process cartridge removably installable in a predetermined space in the main assembly 120 (printer main assembly) of the image forming apparatus. In this embodiment, the process cartridge 100 comprises: a cover 111, which is a elastic frame, and three processing devices: a photosensitive drum 1, a magnetic brush based contact charging apparatus 31, and a developing apparatus 51. The three processing devices are integrally disposed in the cover 111, with the provision of a predetermined positional relationship among them, so that they can be installed into, or removed from, the apparatus main assembly 120 all at once. The process cartridge 100 is enabled to be inserted into, or extracted from, the predetermined space within the apparatus main assembly 120 with the assistance of an installing means 112, following a predetermined procedure. The installation of the process cartridge 100 into the aforementioned predetermined space in the apparatus main assembly 120 causes the process cartridge 100 to become integrally engaged with the apparatus main assembly 120, mechanically as well as electrically.

As the toner stored in the developing apparatus 51 is completely consumed, or the service life of the photosensitive drum 1 expires, the process cartridge 100 is exchanged with a fresh one by a user. A reference numeral 60 designates a storing means with which the process cartridge 100 is provided, and which will be described later.

(2) Operational Sequence of Printer

Figure 2:
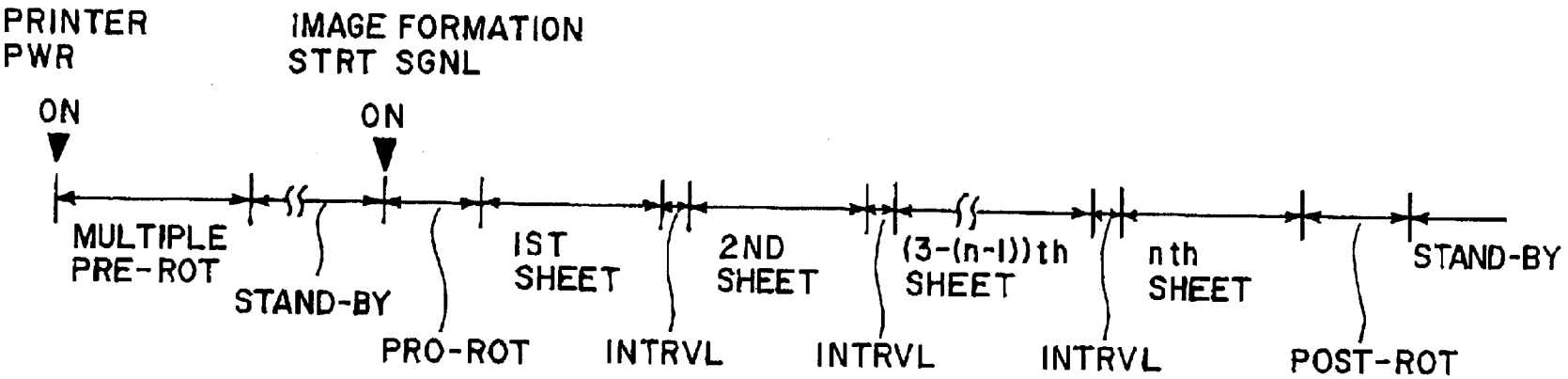
FIG. 2 is a diagram which depicts the operational steps of the image forming apparatus.

FIG. 2 is a diagram which shows the operational sequence of the printer in this embodiment.

a) Preparatory Multiple Rotation Period

This is a period in which a printer operation is initiated; in other words, it is a warm-up period. In this period, a main power switch is turned on to start the main motor (unillustrated) of the printer. As a result, the photosensitive drum 1 is rotationally driven, and the various processing devices are initiated for image formation.

b) Standby Period

After the completion of the predetermined initiation of the printer, the main motor is temporarily stopped. As a result, the rotational driving of the photosensitive drum 1 is temporarily stopped, and the printer is placed in the state of standby, and is kept on standby until a signal for starting image formation (printing) is inputted.

c) Preparatory Rotation Period

As the signal for starting image formation is inputted, the main motor is restarted, causing the photosensitive drum 1 to rotate again for a while, so that additional predetermined preparatory operations for image formation are carried out.

d) Image Formation Period

After the completion of the predetermined preparatory rotation period, the rotating photosensitive drum 1 is immediately put through various image forming processes for the first sheet of recording medium 104. After the transfer of a toner image onto the first recording sheet 104, the recording sheet 104 is conveyed to a fixing apparatus 109.

In the continuous image formation mode, the above described image formation steps are sequentially repeated in the listed order, by the number of times corresponding to the number of copies to be produced.

e) Sheet Interval Period

In the case of the continuous image formation mode, there is an interval between when the trailing end of a recording sheet (104) comes out of the transfer portion T and when the leading end of the following recording sheet (104) reaches the transfer portion T. In other words, there is a period in which no transfer sheet is passing through the transfer portion T. This period is referred to as the sheet interval period.

f) Post-rotation Period

This is the period after the completion of the image formation on the n-th recording sheet, or the last recording sheet. In this period, the main motor is kept on for a certain length of time to keep rotating the photosensitive drum 1 so that the predetermined post-image formation operations are carried out for the printer.

g) Standby Period

After the completion of the post-rotation processes, the main motor is stopped to stop rotationally driving the photosensitive drum 1, and thereafter, the image forming apparatus is again kept on standby until the next signal for image formation is inputted.

When an image formation signal is inputted immediately after the preparatory multiple rotation period, the preparatory multiple rotation process is immediately followed by the pre-rotation process, which is followed by the image formation process. When only one copy is made, the printer is placed in the standby state after being put through the post-rotation process, after the image formation process for the single copy.

Among the periods listed above, the image formation period (d) is a period in which an image is actually formed, and the preparatory multiple rotation period (a), pre-rotation period (c), sheet interval period (e), and post-rotation period are the periods in which no image is actually formed.

(3) Contact Charging Apparatus 31 Employing Magnetic Brush

In this embodiment, the magnetic brush based contact charging apparatus 31 is of a sleeve rotation type.

A reference numeral 32 designates an apparatus housing, and a reference numeral 33 designates a nonmagnetic sleeve (hereinafter, "charge sleeve") as a magnetic brush bearing member, which is 16 mm in peripheral diameter, and is rotatably disposed in the housing 32, with the portions of it exposed therefrom.

A reference numeral 34 designates a magnetic roller as a magnetic field generating means, which is put through the charge sleeve 33, and nonrotatably fixed therein. The charge sleeve 33 is rotationally driven along the peripheral surface of this fixedly disposed magnetic roller 34 in the clockwise direction at a predetermined peripheral velocity.

A reference numeral 35 designates an aggregation of magnetic particles (hereinafter, "charge carrier") stored in the housing 32 as charge carrier. A reference numeral 36 designates a regulatory member (regulatory blade, regulatory plate), which is attached to the housing 31, next to the opening of the housing 32, to regulate the thickness of the magnetic brush, or the magnetic particle layer, with the provision of a predetermined minute gap between itself and the charge sleeve 33. This regulatory member 36 plays a role in regulating the amount (layer thickness) of the charge carrier carried out on the charge sleeve 33 from within the housing 32 as the charge sleeve 33 rotates, so that a proper amount of the charge carrier is carried in a layer as the magnetic brush layer 35*a* on the charge sleeve 33. This regulatory member 36 plays a role in regulating the amount (layer thickness) of the charge carrier carried out on the charge sleeve 33 from within the housing 32 as the charge sleeve 33 rotates, so that a proper amount of the charge carrier is carried in a layer as the magnetic brush layer 35*a* on the charge sleeve 33.

The magnetic brush based contact charging apparatus 31 is disposed adjacent to the photosensitive drum 1 in such a manner that the charge sleeve 33 is placed in parallel to the photosensitive drum 1, with the provision of a predetermined minute gap between the peripheral surfaces of the charge sleeve 33 and the photosensitive drum 1. The size of this gap is such that the magnetic brush 35*a* (charging magnetic brush), regulated in thickness by the regulatory member 36 as described above, is allowed to make contact with the photosensitive drum 1 and rubs the peripheral surface of the photosensitive drum 1. A reference letter N designates the contact nip (charging portion, charging area) formed by this contact between the magnetic brush 35*a* and the peripheral surface of the photosensitive drum 1. In this embodiment, an adjustment has been made so that the nip width of the charging portion N formed by the contact between the magnetic brush and the photosensitive drum 1 becomes approximately 6 mm.

As a predetermined charge bias is applied to the magnetic brush from an unillustrated charge bias application power source through the charge sleeve 33, the peripheral surface of the photosensitive drum 1 is charged to predetermined polarity and potential level, in the charging portion N where the peripheral surface of the photosensitive drum 1 is in contact with the magnetic brush.

The charge sleeve 33 is rotated in the direction counter to the rotational direction of the photosensitive drum 1. In this embodiment, the peripheral velocity of the photosensitive drum 1 is set at 100 mm/sec, whereas the charge sleeve 33 is rotated at a peripheral velocity of 150 mm/sec. As charge voltage is applied to the charge sleeve, electrical charge is given to the peripheral surface of the photosensitive drum 1 from the charge carrier of the magnetic brush 35*a*. As a result, the peripheral surface of the photosensitive drum 1 is charged to a potential level proportional to the charge voltage. The greater the peripheral velocities, the better is the photosensitive drum 1 likely to be charged in terms of uniformity.

The charge carrier 35 is desired to be 10–100 $\mu$m in average particle diameter, 20–250 emu/cm$^3$ in saturation magnetization, and $1\times10^2$–$1\times10^{10}$ $\Omega\cdot$cm in electrical resistance. However, in consideration of the possibility that the photosensitive drum 1 is defective in terms of electrical insulation because it has pin holes, for example, it is preferable to employ a charge carrier that is no less than $1\times10^6$ Ω·cm in electrical resistance. In order to improve the charging performance of the charge carrier 35, the electrical resistance of the charge carrier 35 is desired to be as small as possible. In this embodiment, therefore, a charge carrier, which is 25 μm in average particle diameter, 200 emu/cm$^3$ in saturation magnetization, and $5\times10^6$ in electrical resistance, was employed.

The value of the electrical resistance of the charge carrier 35 is measured in the following manner. That is, two grams of carrier are placed in a metallic cell with a bottom surface size of 228 mm$^2$, and the resistance value is measured while applying a pressure of 6.6 Kg/cm$^2$ and a voltage of 100 V.

As for the selection of the charge carrier 35, there is a resinous carrier produced by dispersing magnetite and carbon black in resin. Magnetite is used as magnetic material, and carbon black is used to give the charge carrier electrical conductivity, and also to adjust the electrical resistance of the magnetic carrier. Also there are: a magnetic carrier produced by oxidizing the surfaces of magnetite particles, for example, ferrite particles, and then, adjusting the electrical resistance thereof by reduction; a magnetic carrier produced by coating the surfaces of magnetic particles such as ferrite particles to adjust their electrical resistance; and the like.

(4) Developing Apparatus 51

The developing apparatus 51 in this embodiment is a developing apparatus which uses a two component magnetic brush. More specifically, it develops, in reverse, an electrostatic latent image into a toner image with the use of a magnetic brush formed of two component developer comprising toner (developer) and magnetic particles (hereinafter, "development carrier").

Reference numerals 52 and 53 designate a developing means container and a development sleeve, respectively. The development sleeve 53 is rotatably disposed within the developing means container 52, with its peripheral surface partially exposed from the developing means container 52. A reference numeral 54 designates a magnetic roller, which is put through the development sleeve 53, and is nonrotatably fixed therein. A reference numeral 55 designates a developer coating blade, and a reference numeral 56 designates two component developer stored in the developing means container 52. Reference numerals 57 and 58 designate developer stirring screws, which are disposed in the bottom side of the developing means container 52.

The two component developer 56 within the developing means container 52 is a mixture of toner and titanium oxide. The toner is manufactured using the pulverization method, has an average particle diameter of 6 μm, and is negatively chargeable. The titanium oxide is 20 nm in average particle diameter, and is externally added to the toner by a weight ratio of 1%. As for the development carrier, magnetic particles which are 205 emu/cm$^3$ in saturation magnetization, and 35 μm in average particle diameter, is used. The mixture ratio in weight between the above described toner and development carrier is 6:94.

The development sleeve 53 is rotationally driven in the counterclockwise direction indicated by an arrow mark at a predetermined peripheral velocity. As the development sleeve 53 is rotated, a certain amount of the two component developer 56 is adhered to the peripheral surface of the development sleeve 53 by the magnetic force from the magnetic roller 54 within the development sleeve 53, is held thereon as a magnetic brush layer, and is conveyed in the rotational direction of the development sleeve 53, while being formed into an even, thin magnetic brush layer 56*a* by the develop coating blade 55. The development sleeve 53 is disposed so that the gap between the photosensitive drum 1 and development sleeve 53, at the point where the gap between the peripheral surfaces of the components is smallest, becomes 500 μm at least during an image development period. The area immediately adjacent to this point where the gap between the peripheral surfaces of the development sleeve 53 and photosensitive drum 1 is smallest constitutes a developing portion G (developing area). The image forming apparatus is configured so that the thin layer 45*a* of the developer (thin magnetic brush layer formed of two component developer) formed on the development sleeve 53 makes contact with the peripheral surface of the photosensitive drum 1 in this developing portion G to develop a latent image. To the development sleeve 53, a predetermined development bias is applied from an unillustrated development bias application power source.

Thus, after the two component developer is coated in the thin layer 56*a* on the peripheral surface of the rotating development sleeve 53, and conveyed to the developing portion G, the toner portion thereof is adhered to the selected areas of the peripheral surface of the photosensitive drum 1, that is, the areas corresponding to the electrostatic latent image on the peripheral surface of the photosensitive drum 1, by the electric field generated by the aforementioned development bias. As a result, the electrostatic latent image is developed into a toner image. In this embodiment, the electrostatic latent image on the peripheral surface of the photosensitive drum 1 is reversely developed; in other words, the toner is adhered to the exposed areas (light areas) of the peripheral surface of the photosensitive drum 1.

After passing through the developing portion G, the thin layer of developer on the development sleeve 53 is returned to the pool of developer within the developing means container 52 by the further rotation of the development sleeve 53.

In order to maintain the toner density of the two component developer 56 within the developing means container 52, within a predetermined approximate range, the following process is carried out. That is, the toner density of the two component developer 56 in the developing means container 52 is detected by an unillustrated optical toner density sensor, and based on the detected information, the toner within an unillustrated replenishment toner storage portion is supplied to the two component developer 56 within the developing means container 52. The toner supplied to the two component developer 56 is stirred, along with the two component developer 56, by the stirring screws 57 and 58, so that it is evenly distributed in the two component developer 56. There is provided a toner remainder detecting means (developer remainder detecting means) for detecting the amount of the toner remainder within the replenishment toner storage portion.

(5) Cleaner-less System

Immediately after the toner image transfer, there remains a certain amount of toner on the peripheral surface of the photosensitive drum 1. As described above, the printer in this embodiment is a cleaner-less printer. Thus, as the photosensitive drum 1 is further rotated, the transfer residual toner on the photosensitive drum 1 is conveyed to the charging portion N. In the charging portion N, the transfer residual toner is temporarily recovered by the magnetic brush type contact charging apparatus 31, and then, is ejected back onto the peripheral surface of the photosensitive drum 1 in a manner to be evenly distributed across the peripheral surface of the photosensitive drum 1. Thereafter, the evenly distributed residual toner is conveyed to the developing portion G, in which it is recovered into the developing apparatus 51 by the development bias at the same time as the latent image on the peripheral surface of the photosensitive drum 1 is developed in reverse by the developing apparatus 51.

In the case of the above described transfer residual toner recovery process, if the transfer residual toner remaining adhered to the peripheral surface of the photosensitive drum 1 is conveyed from the transferring portion T to the charging portion N, and then is passed, as it is, through the charging portion N, the aforementioned ghost is generated. In other words, when the transfer residual toner passes through the charging portion N, in contact with the magnetic brush 35*a,* as a contact charging member, in contact with the peripheral surface of the photosensitive drum 1, the shape of the preceding image remains virtually intact; under the proper charging condition for the magnetic brush 35*a,* it does not occur that the transfer residual toner is evenly distributed by the magnetic brush 35*a.*

Thus, the transfer residual toner which has reached the charging portion N as the photosensitive drum 1 further rotates needs to be taken into the magnetic brush 35*a* (i.e., charging apparatus 31), to erase the effect, or history, of the preceding image. Application of DC voltage alone to the magnetic brush 35*a* is not enough to successfully move the transfer residual toner into the magnetic brush 35*a.* However, the application of AC voltage, along with DC voltage, to the magnetic brush 35*a* causes the transfer residual toner to be relatively easily moved into the charging apparatus, because of the effects of the oscillating electric field generated between the photosensitive drum 1 and magnetic brush 35*a.*

Nonetheless, depending on the amount of the electrical charge that the transfer residual toner that has reached the charging portion N holds, there occurs a situation in which it is very difficult for the magnetic brush to take in the toner. In other words, since it is inevitable that the transfer residual toner holds a certain amount of electrical charge, the difference in potential level between the magnetic brush and photosensitive drum, and the mirror force between the toner and photosensitive drum, substantially affects how well the magnetic brush takes in the transfer residual toner.

It is ideal that a given portion on the peripheral surface of the photosensitive drum 1 is charged to a potential level equal to the potential level of the voltage applied to the magnetic brush, while this portion passes by the magnetic brush 35*a,* in contact therewith. In reality, however, at the beginning of the duration of their contact, there is a certain amount of difference in potential level between the magnetic brush and this given portion of the photosensitive drum, because the contact portion (charging portion) between the magnetic brush 35*a* and the peripheral surface of the photosensitive drum has a certain width, and it does not occur that the given portion of the peripheral surface of the photosensitive drum is fully charged at the upstream end of the contact portion, although it is charged to the potential level virtually equal to the potential level of the voltage applied to the magnetic brush 35*a* by the time this portion of the peripheral surface of the photosensitive drum comes out of the contact portion In the case of this embodiment, the potential level Vdc (dark potential level) to which the peripheral surface of the photosensitive drum is to be charged by the magnetic brush based contact charging apparatus 31 is set at −700 V. Therefore, across the upstream side of the charging portion, which corresponds to the initial stage of charging, the surface potential level of the photosensitive drum is lower than −700 V. Thus, across this charging portion, the negatively charged toner is not taken into the magnetic brush 35*a,* although the positively charged toner is easily taken into the magnetic brush 35*a.* Further, when the amount of electrical charge which the transfer residual toner holds is extremely large, the mirror force between the toner and the photosensitive drum is excessively large, and therefore, the toner remains on the photosensitive drum.

Thus, even though the toner is negatively chargeable in nature, it is desired that the transfer residual toner is holding positive charge. However, even if the transfer residual toner is not holding positive charge, as long as the absolute value of the amount of the charge held by the transfer residual toner is sufficiently small, it can be expected that the transfer residual toner is forcefully raked in by the magnetic brush 35*a.*

In reality, it occurs quite often that the polarity of the charge of the transfer residual toner is reversed by electrical discharge which occurs as recording medium is separated from the photosensitive drum at the end of the transfer process, or the like. If such reversal of the polarity of the transfer residual toner occurs, the distribution of the transfer residual toner in terms of the amount of electrical charge is substantially changed by transfer current even if transfer efficiency remains the same. Further, if the developer is used for an extended period, the developer itself deteriorates, becoming inferior in transfer efficiency, which results in the increase in the ratio of the amount of the toner which remains negatively charged, and therefore, remains on the photosensitive drum.

Therefore, it is desired to provide a means for strengthening the transfer current, a means for charging the transfer residual toner to the reverse polarity, and the like.

In this embodiment, a brush 37 (supplementary charging brush) formed of electrically conductive rayon fiber was provided as a means for charging the transfer residual toner to the reverse polarity. It was 6 mm in fiber length and was positioned between the transfer portion T and charging portion N, in contact with the photosensitive drum 1. The contact nip between this brush 37 and the photosensitive drum 1 was 7 mm in width. To this rayon brush 37, a DC voltage of 500 V, that is, a voltage opposite in polarity to the toner, is applied from an unillustrated electrical power source.

Since the positive bias is applied to the brush 37, the transfer residual toner, which is negative in polarity, is temporarily captured into the brush 37, in which the toner is stripped of its negative electrical charge. Then, the toner is sent back onto the photosensitive drum 1. This means that, by the time the transfer residual toner reaches the charging portion N, it will have been positively charged, or will have been stripped of negative charge and become such toner that has a relatively small amount of negative charge. Therefore, it becomes easier for the transfer residual toner to be recovered by the magnetic brush 35*a.* After being recovered into the magnetic brush 35*a,* the transfer residual toner is again charged to the negative polarity due to the friction between the toner and the charge carrier within the magnetic brush, and is ejected onto the peripheral surface of the photosensitive drum 1 in a manner to uniformly cover the peripheral surface of the photosensitive drum 1.

After being negatively charged by the magnetic brush 35*a* of the charging apparatus 31, and ejected onto the peripheral surface of the photosensitive drum 1 in a manner to be evenly distributed across the peripheral surface of the photosensitive drum 1, the transfer residual toner reaches the developing portion G, in which it is recovered into the developing apparatus 51 by the bias for reversal development, at the same time as the latent image is developed by the bias for reversal development.

In the above, description is provided regarding the fact that the transfer residual toner needs to be taken into the charging apparatus 31, and also regarding the necessary conditions therefor and the method therefor. However, it must be pointed out here that improvement in the efficiency with which the toner is taken in is detrimental to the efficiency with which the toner is ejected or charged. As the toner accumulates in the charging apparatus, that is, as the charge carrier 35 is contaminated by the toner, the electrical resistance value of the charge carrier 35 increases. As the charge carrier 35 increases in electrical resistance value, its charging performance declines. Thus, after being taken into the magnetic brush, the transfer residual toner must be ejected as soon as possible.

The application of DC voltage alone to the charging apparatus improves ejection efficiency, and extends the durability of the charge carrier by preventing the charge carrier from deteriorating. However, when it is only DC voltage that is applied to the charging apparatus, the charging apparatus is inferior in terms of charging performance and charge carrier deterioration, compared to when AC voltage is applied along with DC voltage. For example, when a voltage of 700 V is applied to charge the photosensitive drum to a potential level target of 700 V, the photosensitive drum is charged to only approximately 690 V, even at the beginning of the service life of a process cartridge.

In addition, as the magnetic brush 35*a* deteriorates due to extended usage, the attainable potential level further falls, and therefore, the difference between when only DC voltage is applied and when AC voltage is applied along with DC voltage, gradually widens.

Figure 3:
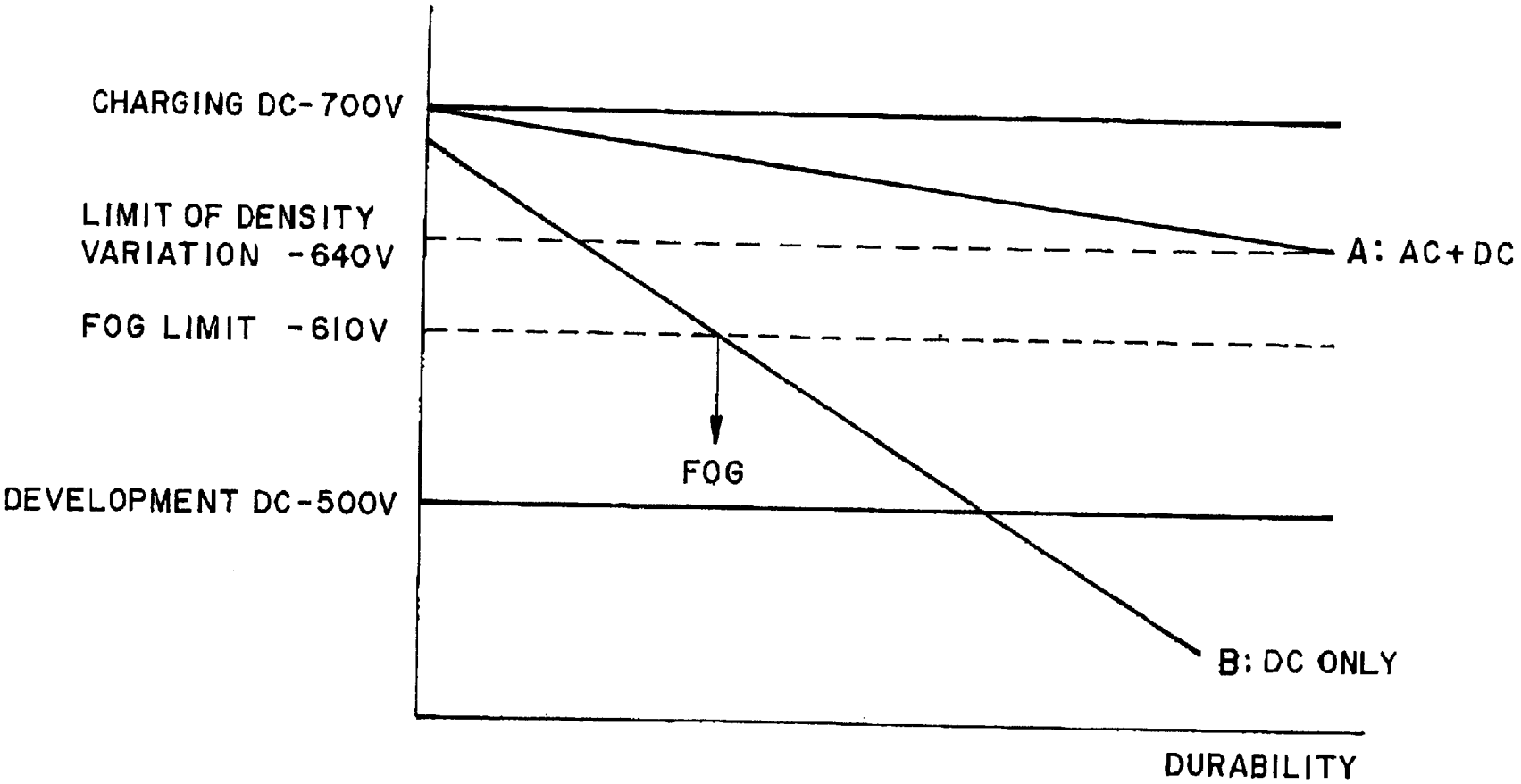
FIG. 3 is a graph (1) for depicting the change in the potential level attained by the charge injection which uses a magnetic brush.

Therefore, eventually, the photosensitive drum fails to be charged to a potential level necessary to maintain a sufficient amount of reverse potential relative to the value of the DC component of the development bias, resulting in overdevelopment, as shown in FIG. 3.

If the amount of the reduction in potential level relative to the initially set potential level exceeds a certain value, the density in an output image exceeds a tolerable level due to the change in the potential level of the exposed portion.

Thus, it is desired that, while a sheet of recording medium is passed, AC bias with a proper amplitude is continuously applied. Further, the toner must be ejected during sheet intervals, and pre- and post-rotation.

The occurrence of over development automatically leads to the increase in the amount of the transfer residual toner, and therefore, even during the sheet intervals and post-rotation, the potential level of the photosensitive drum must be maintained at least at the lowest point of the potential level range in which over development does not occur.

Figure 4:
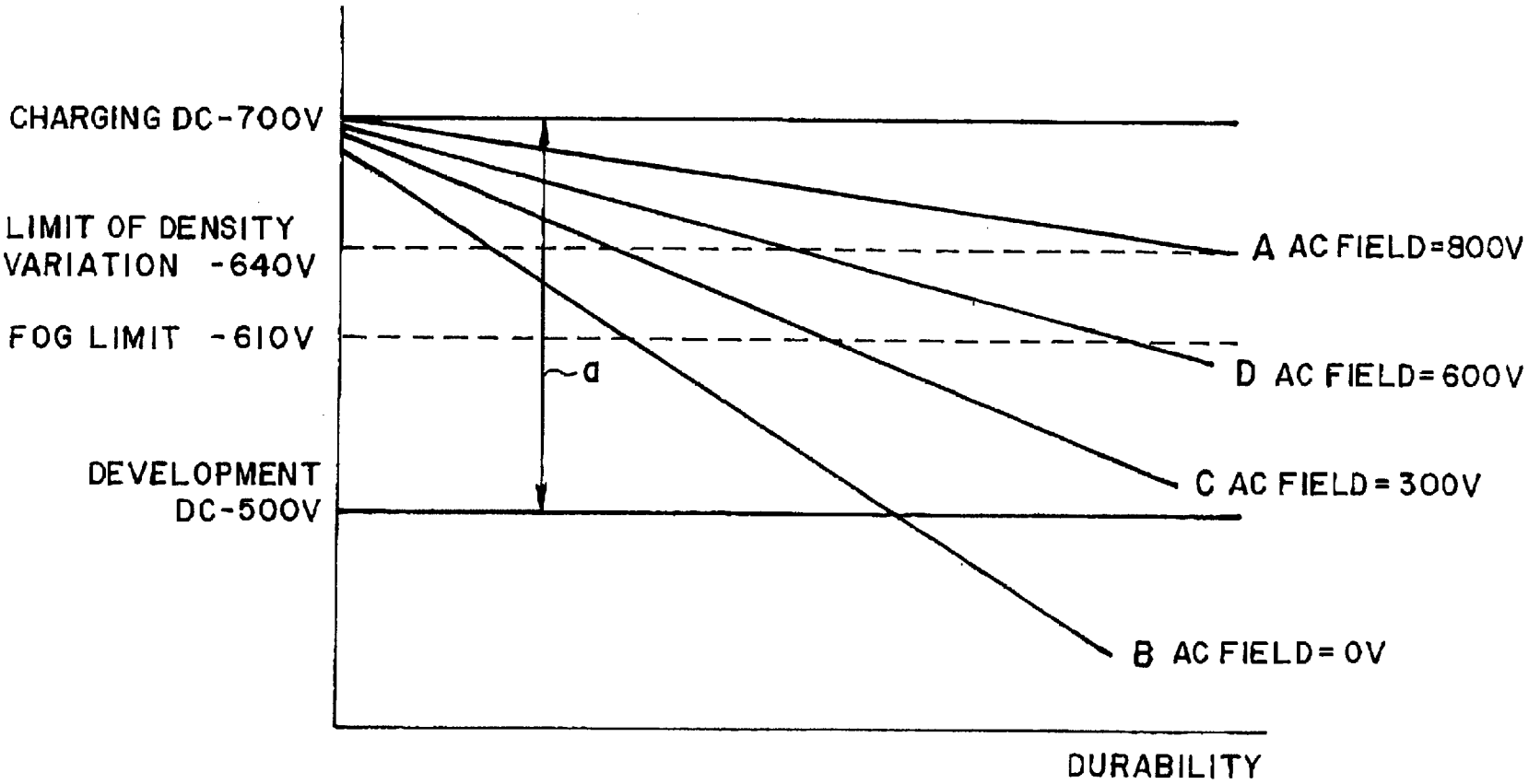
FIG. 4 is a graph (2) for depicting the change in the potential level attained by the charge injection which uses a magnetic brush.

However, the condition under which the density change, with which the sheet intervals and post-rotation are not involved, occurs, is far more difficult to control than the condition under which the photosensitive drum is charged to the potential level below which it is normal for overdevelopment to occur. Further, when a plurality of prints with a high image ratio, such as a print covered with a solid image, are continually outputted, it is conceivable that the toner density within the magnetic brush 35*a* temporarily increases, which in turn temporarily reduces the charging performance of the magnetic brush 35*a,* and as a result, ghosts are generated across the image portion, or the necessary reverse potential fails to be maintained. Therefore, it is desired that AC voltage is continuously applied during the image formation, and the toner ejection bias is applied during the sheet intervals or post-rotation. Referring to FIG. 4, a line A represents the decline of the attained potential level which occurred while 3,000 copies with an image ratio of 6% were outputted with the amplitude of the AC electric field kept constant at 800 V. As the difference between the charge potential level and development potential level became smaller than 110 V, the non-image areas were overdeveloped. As the charge potential level became lower by 60 V than the initial charge potential level, the image density became drastically different from the initial image density, which signaled the end of the service life of the charging apparatus. The reason the development potential level target was set at −500 V, whereas the charge potential level target was set at −700 V, is that if the difference, represented by an arrow mark a in the drawing, between the development potential level and charge potential level exceeds 200 V, the development carrier adheres to the photosensitive drum. This means that the possible range of the charge potential level of the image portion is no less than −640 V and no more than −700 V, although, during the sheet intervals or post-rotation, it may be no less than −610 V and no more than −700 V.

Referring again to FIG. 4, lines B, C, and D represent the declines of the attained potential level which occurred under the same condition as described above, except that the applied AC voltages were 0 V, 300 V, and 600 V, correspondingly. There was a tendency that as the AC electric field weakened, the amount of the decline in attained potential level increased.

Figure 5:
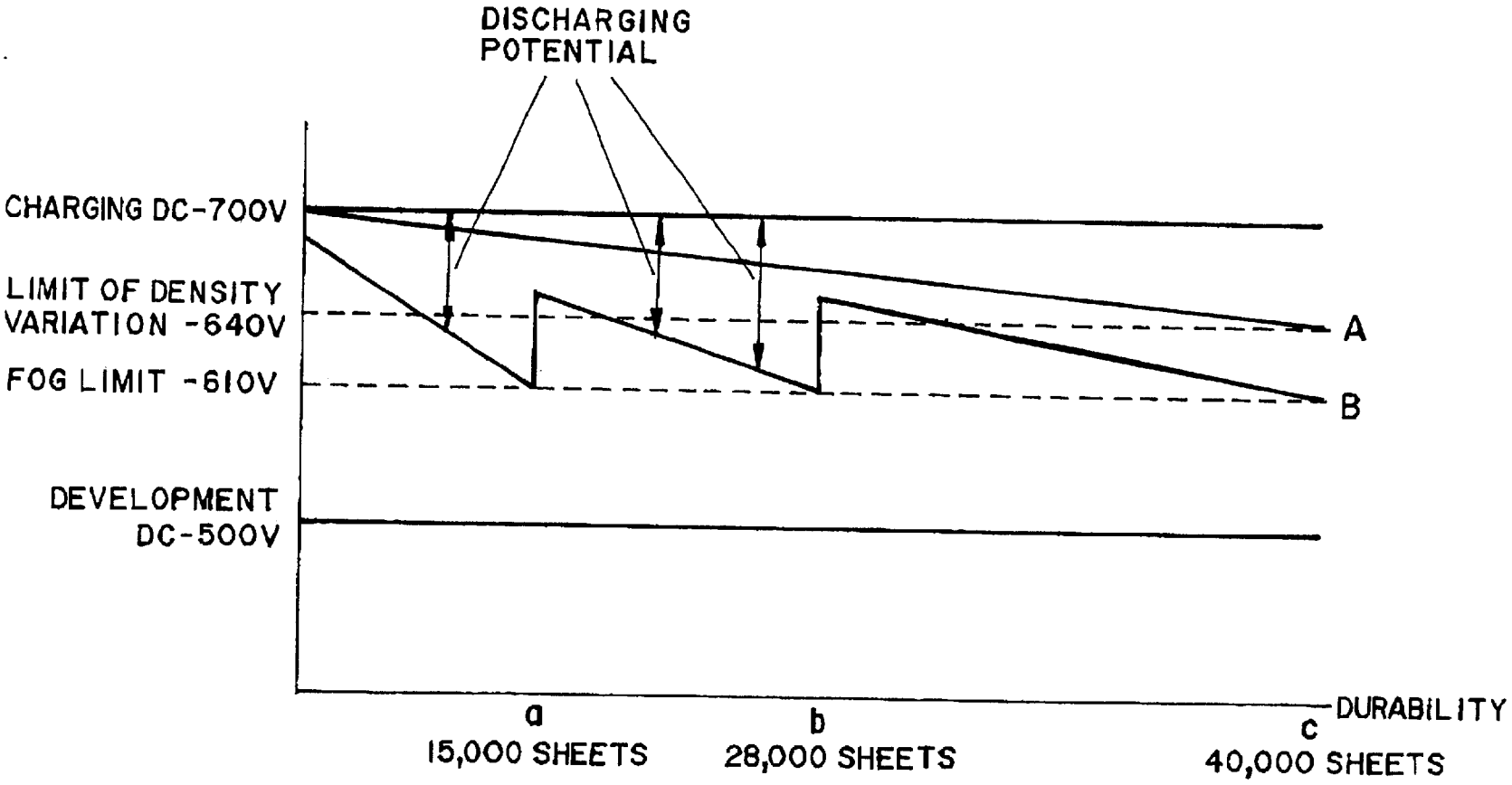
FIG. 5 is a graph for depicting the change in the potential level attained by the charge injection which uses a magnetic brush, in the first embodiment.

FIG. 5 shows the changes in potential level which occurred when control was executed in accordance with the present invention. In the graph, line A represents the potential level across the portion of the peripheral surface of the photosensitive drum 1 corresponding to sheet passage, when an AC voltage of 800 V was applied. Line B represents the potential level across the portion of the peripheral surface of the photosensitive drum 1 corresponding to the post-rotation which lasted six seconds, and the sheet intervals. In the case of line B, initially, DC voltage alone was applied, and then, the amplitude of the AC voltage was increased in steps as the amount of printing reached points a and b.

The difference between the potential level (−700 V) of the voltage applied to the charging member, and the potential level to which the photosensitive drum is actually charged, functions as toner ejection bias. Therefore, the above described control executed in accordance with the present invention can substantially reduce the toner accumulation within the charging apparatus, compared to when AC bias is applied from the beginning. In the case of this embodiment, the service life of the charging apparatus could be extended to an equivalency of 5,000 copies.

In this embodiment, the values of a, b, and c were equivalent to 15,000, 28,000, and 40,000 copies with an image ratio of 6%.

(6) Service Life Expiration Warning for Process Cartridge 100

The process cartridge 100 (hereinafter, abbreviated as "cartridge") is exchanged by a user after the toner stored in the developing apparatus 51 is completely consumed, or as the photosensitive drum 1 reaches the end of its service life.

This embodiment is characterized in that the cartridge 100 is provided with an information storing means 60 in which information regarding the cumulative amount of printing is stored, and as the cumulative amount of printing exceeds a predetermined value, charge bias is changed so that the toner which has mixed into the aforementioned charge brush by this point in time is ejected while keeping stable the potential level to which the image bearing member is charged.

Regarding the selection of an information storing means, there is no restriction. In other words, any information storing means may be employed as long as it is capable of rewritably storing and holding information in the form of a series of electrical signals. For example, an electrical information storing means such as an RAM or a rewritable ROM, or magnetic information storing means such as a magnetic recording medium, a magnetic bubble memory, or a photomagnetic memory may be employed.

In this embodiment, from the standpoint of ease of handling and cost, an NV (nonvolatile) RAM was employed as the information storing means.

Figure 6:
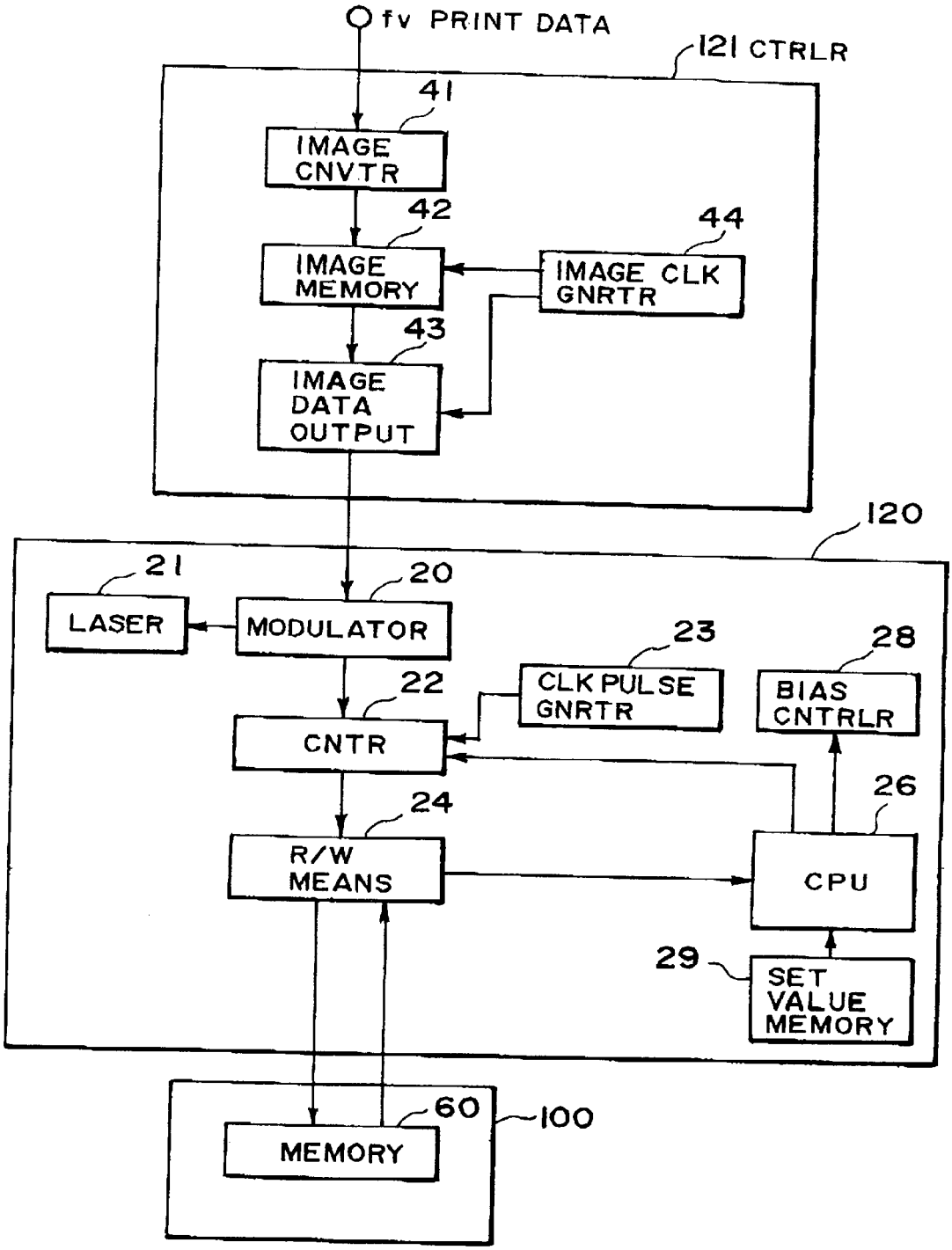
FIG. 6 is a block diagram for describing the operation of the image forming apparatus.

FIG. 6 is a block diagram for describing the bias control system of the printer in this embodiment. It shows the cartridge 100, the main assembly 120 (printer main assembly), and a controller 121 which converts printing data into printable signals.

The cartridge 100 is provided with the information storing means 60. In this embodiment, the length of time the laser 21 is kept on is counted, as the information which represents the amount of printing, from the beginning of an image forming operation, and the value of the count is stored as the time information, in the information storing means 60 within the cartridge 100.

The printing data fv inputted from a host computer (unillustrated) or the like is inputted into the controller 121, in which the printing data fv are developed into dot data in an image development portion 41. The developed printing data are stored once in an image memory 42, and then, are sent as serial image signals to the apparatus main assembly 120 through an image data outputting portion 43. A reference numeral 44 designates a means for generating clock signals.

After having been sent to the apparatus main assembly 120 from the controller 121, the image signals are inputted into a modulator 20, in which the laser input voltage is modulated with the image signals so that the laser 21 is turned on or off in accordance with the image signals fv. In other words, the laser 21 is connected to the modulator 20, and emits light in accordance with the modulated input voltage. To the modulator 20, a counter 22 is connected, and by this counter 22, the duration of the output from the modulator 20 to the laser 21, that is, the time information which concurs with the length of time the photosensitive drum 1 is exposed to the laser beam outputted from the laser 21, is measured.

More specifically, to the counter 22, a clock pulse generating means such as a quartz oscillator is connected, and the value obtained by counting the number of clock pulses received while the laser emission signal lasts is used as the time information.

The obtained clock pulse count is cumulatively written by a reading/writing means 24, in the information storing means 60 which is provided in the cartridge 100.

In this embodiment, the exposure time by the laser 21 is directly counted as the clock pulse count. Therefore, multivalued signals, which prolong the light emitting time of the laser 21, for a single dot picture element in a high density area of an image, and shorten the light emitting time of the laser 21, for a single dot picture element in the medium density area in an image, can also be used as image signals.

The time information written into the information storing means 60 is written back into the apparatus main assembly 120 by the reading/writing means 24. This information in the form of a certain value is compared to the predetermined value which has been set in the CPU 26. When this value is greater than the set value, the charge bias is switched by a bias controlling means 28. There may be provided a plurality of the set values. For example, when three values of a, b, and c have been provided, the charge bias is switched to three different values depending on whether the time information T read out of the information storing means 60 satisfies: $a>T$, $a \leqq T<b$, or $b \leqq T<c$. When it satisfies; $T \geqq c$, a user is warned that the service life of the cartridge has ended.

Figure 7:
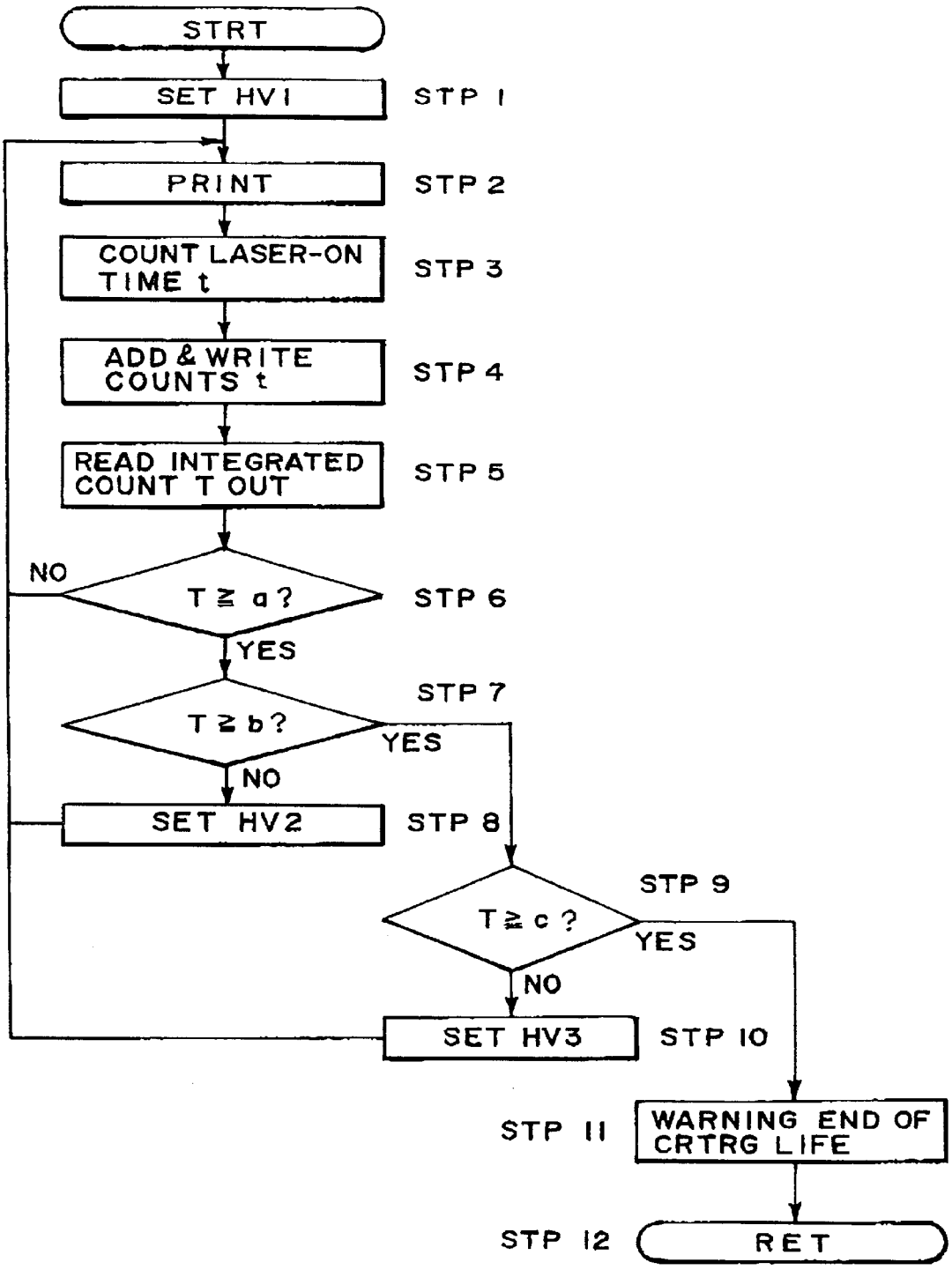
FIG. 7 is a flow chart for describing the operation of the image forming apparatus.

Next, referring to the flow chart in FIG. 7, the actual operational flow of the image forming apparatus in this embodiment will be described.

As a printing operation is initiated, first, the number of clock pulse count value t, which concurs with the length of time the laser 21 is kept on, is measured (step 2), and this value t is cumulatively written into the information storing means 60 by the reading/writing means 24 (step 3).

The cumulative value T of the clock pulse count value t written into the information storing means 60 is read back into the apparatus main assembly 120 (step 4), in which it is sequentially compared with the set values a, b, and c to determine the high voltage value.

When $T<c$, a user is warned of the expiration of the service life of the cartridge (step 10); it is suggested that the cartridge 100 be replaced.

Figure 8:
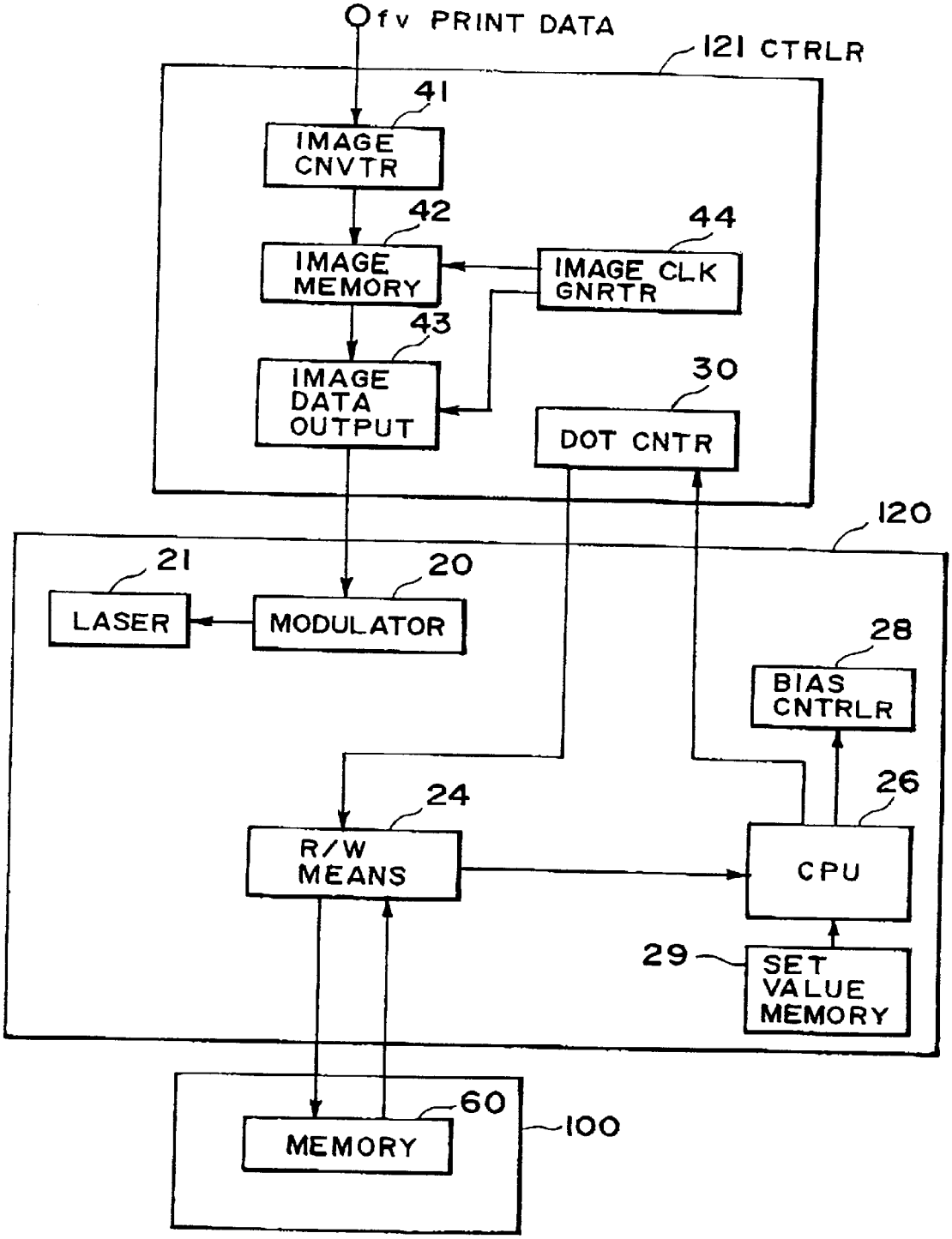
FIG. 8 is a block diagram for describing the operation of the image forming apparatus in the second embodiment of the present invention.

<Embodiment 2> (FIG. 8)

Next, referring to FIG. 8, the second embodiment of the present invention will be described.

FIG. 8 is an operational block diagram of the image forming apparatus in this embodiment. This embodiment is characterized in that the number of dots developed in the controller 121 is directly counted as the information which concurs with the amount of printing, and the count value is stored in the information storing means 60 within the cartridge 100.

This method of counting the number of printing dots is not compatible with a case in which multivalued image signals are provided by changing the duty ratio of the length of time the laser is kept on as described regarding the first embodiment. However, in the case of this method, all that is necessary is to count the number of dots, which are printed in accordance with the image signals and image clock signals, making it unnecessary to provide the clock pulse generating means 23 (FIG. 6) within the apparatus main assembly 120. In other words, this method makes it possible to simplify the circuit structure. Therefore, it is advantageous from the standpoint of cost.

Referring to FIG. 8, a dot counter 30 provided within the controller 121 is a counter for counting the number of dots printed in accordance with the serial image signals and image clock. The serial image signals are outputted by an image data outputting portion 43. The thus obtained printing dot count value is sent to the apparatus main assembly 120, and cumulatively written into the information storing means 60 within the cartridge 100, by the reading/writing means 24.

After being written into the information storing means 60, the count value is sent to CPU 26.

Except for the above described feature, this embodiment is identical in structure to the first embodiment, and therefore, the detailed description of the other structures of the image forming apparatus in this embodiment will be omitted.

In this embodiment, the number of print dots is counted as the information which concurs with the amount of printing. Therefore, it is possible to simplify the structure of the circuit which controls the bias applied for charging the photosensitive drum 1.

In this embodiment, the dot counter 30 is provided in the controller 121. However, the counter 30 may be provided in the apparatus main assembly 120, and in such a case, the image clock signals are sent to the apparatus main assembly 120.

Figure 9:
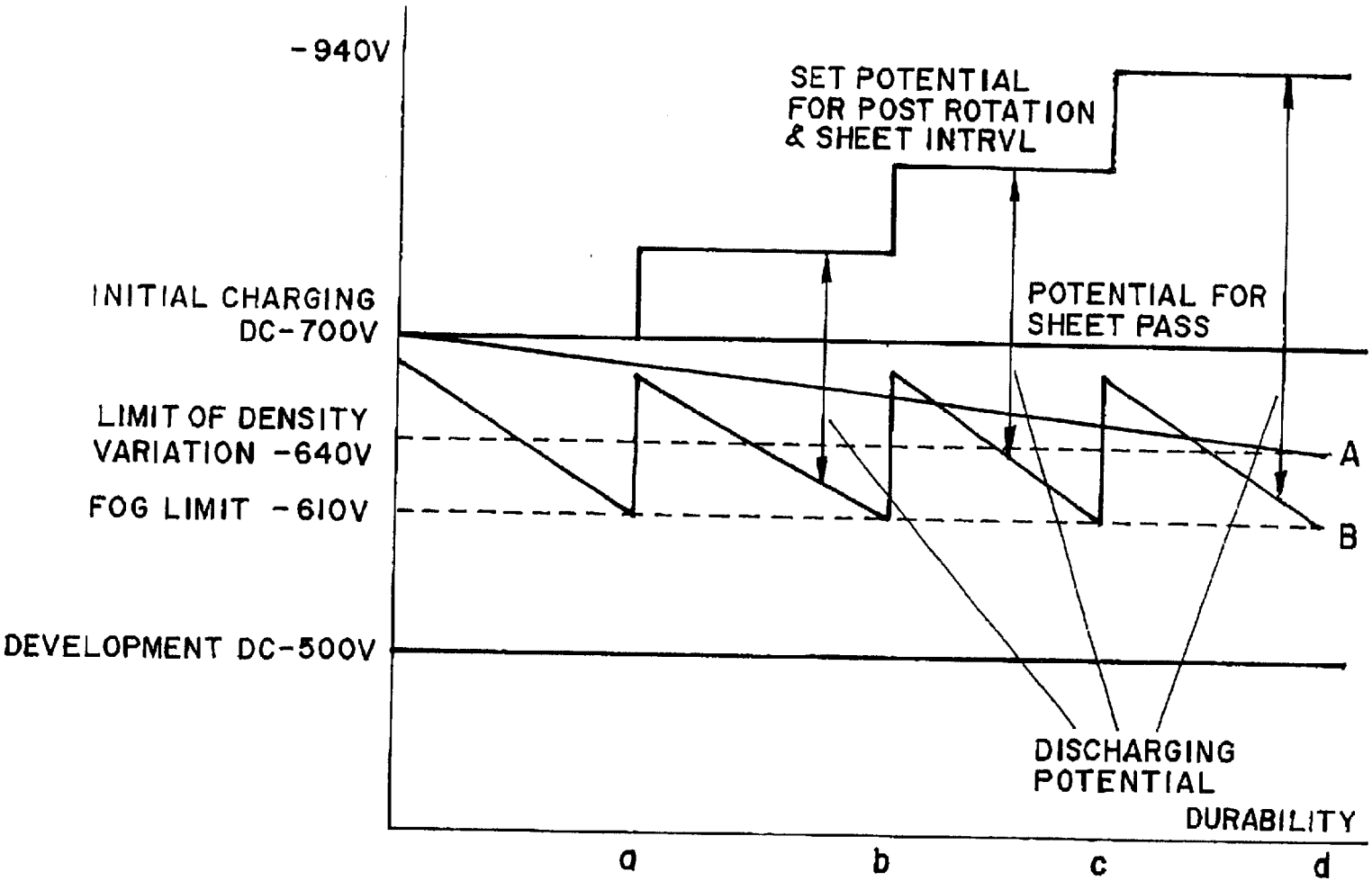
FIG. 9 is a graph for describing the change in the potential level attained by the charge injection which uses a magnetic brush, in the third embodiment of the present invention.

<Embodiment 3> (FIG. 9)

Next, the third embodiment of the present invention will be described.

This embodiment is characterized in that the DC bias applied to charge the photosensitive drum 1 during the sheet intervals and post-rotation is increased as the cumulative value of the printing information stored in the information storing means 60 reaches a preset value.

As represented by line B in FIG. 3, when a DC voltage of −700 V was applied as the charge bias during the sheet intervals and post-rotation, the potential level to which the photosensitive drum 1 could be charged gradually fell, and after the production of 10,000 copies, it fell into the range in which overdevelopment occurred during the sheet intervals and post-rotation.

Thus, in this embodiment, the DC bias was increased by 80 V to −780 V at a point in time equivalent to the production of 15,000 copies. As a result, the potential level to which the photosensitive drum 1 could be charged recovered to −690 V, which was virtually the same as the potential level to which the photosensitive drum 1 could be initially charged.

Thereafter, the DC bias was again increased by 80 V at a point in time equivalent to the production of 25,000 copies, and again increased by 80 V at a point in time equivalent to the production of 35,000 copies.

Thereafter, at a point in time equivalent to the production of 50,000 copies, the potential level to which the photosensitive drum 1 could be charged became −610 V, and also at this point in time, the potential level attained during the sheet passage period during which an AC voltage of 800 V was constantly applied was −640 V at which the image density was virtually the same as the initial image density.

In other words, in this embodiment, the values of the a, b, and c, which were described in first embodiment, were set to be equivalent to the production of 15,000, 25,000, 35,000, and 50,000 copies with an image ratio of 6%. As a result, the service life of the charging apparatus could be drastically extended. The DC bias charged at the end of the service life was −940 V, signaling that the service life of the charging apparatus had ended, because, as the DC bias, that is, the difference in potential between the surface of the magnetic carrier bearing sleeve (charge sleeve) and the photosensitive drum, exceeds 240 V, the amount of the magnetic carrier (charge carrier) which adheres to the photosensitive drum suddenly increases, and the magnetic carrier begins to leak.

The above described change in the attained potential level is shown in FIG. 9. Except for the above described feature, this embodiment is identical to the first embodiment.

Further, in this embodiment, the potential level corresponding to image areas is not controlled. However, it is easily conceivable that the service life of the charging apparatus can be further extended by increasing the value to which the DC voltage is set to charge the photosensitive drum, while applying proper AC bias along with the DC bias, during the post-rotation and sheet intervals.

<Embodiment 4>

Figure 10:
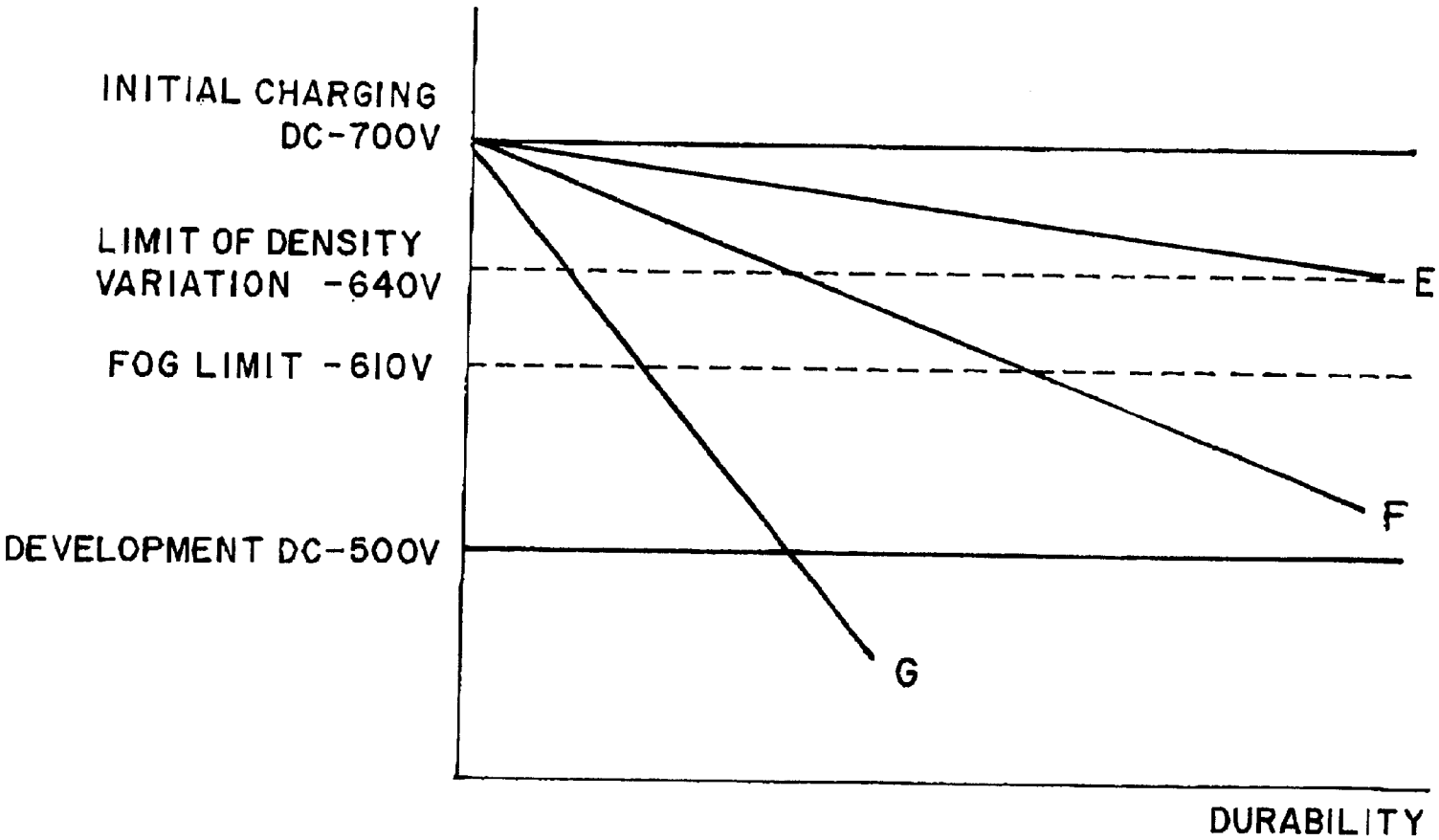
FIG. 10 is a graph which shows the relationship between the reduction in the attained potential level and the value of the cumulative amount of printing.

Referring to FIG. 10, which shows the decline in the attained potential level relative to the cumulative value of the amount of printing, and in which lines E, F, and G represent when the image ratio was 6%, 12%, and 24%. According to FIG. 10, when the image ratio was 12%, the cumulative amount of printing reached a given value after the production of a half the number of copies, compared to when the image ratio was 6%, and when the image ratio was 24%, the cumulative amount of printing reached the given value after the production of a half of a half the number of copies, compared to when the image ratio was 6%. However, the above three image forming operations are different in the cumulative time of the post-rotation or sheet intervals during which ejection bias is applied. Therefore, even if the three image forming operations are identical in the cumulative amount of printing, the higher the image ratio, the sooner the attained potential level declined.

Thus, in this embodiment, the cumulative value of the amount of printing was adjusted according to the print count, to be used as an index for predicting the degree of charging performance deterioration.

More specifically, as an image ratio was doubled, the ratio, at which the attained potential level declined, became 1.2 times the ratio, compared to the original image ratio. Thus, an index K which indicated the degree of charging performance deterioration (an index which indicates the degree of charge carrier deterioration) was established, the value of which was obtained by the following equation, in which P stands for print count and T stands for the cumulative amount of printing:

$$(T/p)^{0.26}*T=K \quad (1).$$

Figure 11:
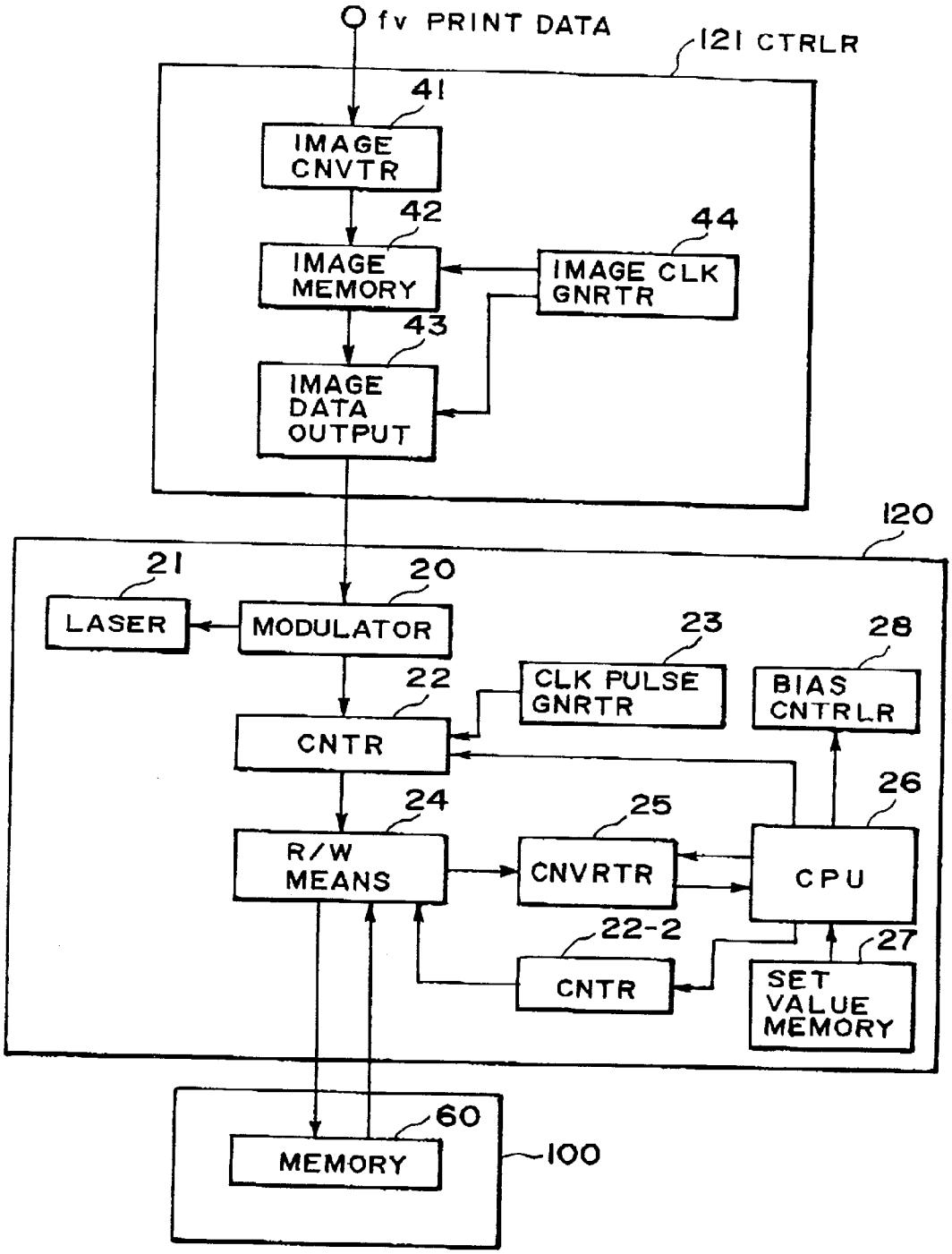
FIG. 11 is a block diagram for describing the operation of the image forming apparatus.

FIG. 11 is a block diagram for describing the bias control mechanism in the printer in this embodiment, and shows the cartridge 100, the apparatus main assembly 120, and the controller 121, which converts the printing data into printable signals.

The cartridge 100 is provided with an information storing means 60. In this embodiment, the length of time the laser 21 is kept on is counted, as the information which represents the amount of printing, starting from the beginning of an image forming operation, and the value of the count is stored as the time information, in the information storing means 60 within the cartridge 100.

The printing data fv inputted from a host computer (unillustrated) or the like is inputted into the controller 121, in which the printing data fv are developed into dot data by the image development portion 41. The developed printing data are stored once in the image memory 42, and then, are sent as serial image signals to the apparatus main assembly 120 through an image data outputting portion 43. A reference numeral 44 designates a means for generating clock signals.

After having been sent to the apparatus main assembly 120 from the controller 121, the image signals are inputted into a modulator 20, in which the laser input voltage is modulated with the image signals so that the laser 21 is turned on or off in accordance with the image signals fv. In other words, the laser 21 is connected to the modulator 20, and emits light in accordance with the modulated input voltage. To the modulator 20, a counter 22 is connected, and by this counter 22, the duration of the output from the modulator 20 to the laser 21, that is, the time information which concurs with the length of time the photosensitive drum 1 is exposed to the laser beam outputted from the laser 21, is measured.

More specifically, to the counter 22, a clock pulse generating means such as a quartz oscillator is connected, and the value obtained by counting the number of clock pulses received while the laser emission signal lasts is used as the time information.

The obtained clock pulse count is cumulatively written by a reading/writing means 24, in the information storing means 60 which is provided in the cartridge 100.

In this embodiment, the exposure time by the laser 21 is directly counted as the clock pulse count. Therefore, multivalued signals, which prolong the light emitting time of the laser 21, for a single dot picture element in a high density area of an image, and shorten the light emitting time of the laser 21, for a single dot picture element in the medium density area in an image, can also be used as image signals.

The time information written into the information storing means 60 is written back into the apparatus main assembly 120 by the reading/writing means 24, and sent to a converting means 25.

On the other hand, regarding the usage information which concurs with the amount of the usage of the cartridge 100, the print count is obtained by counting means 22-2 based on the operation signal sent from the CPU 26 within the apparatus main assembly 120, and is cumulatively written into the information storing means 60 by the reading/writing means 24.

After being written into the information storing means 60, the usage amount information is read back into the apparatus main assembly 210 by the reading/writing means 24, and sent to the converting means 25.

The converting means 25 calculates an index which represents the degree of the deterioration of the charging device, based on the information regarding the amount of cartridge usage and the amount of printing. The converting means 25 is connected to the CPU 26. The index obtained by the converting means 25 is compared to a value preset to represent a given degree of the deterioration of the charging device. If the index is greater than the preset value, the charge bias is switched by the bias controlling means 28.

A plurality of values may be preset as the values with which the index is compared. For example, when the preset values are a, b, and c, and the value T calculated by the converting means 25 satisfieds $a>T$, $a \leqq T<b$, and $b \leqq T<c$, three different bias values are set. If the value T satisfies: $T \geqq c$, a user is warned of the end of the service life of the cartridge.

Figure 12:
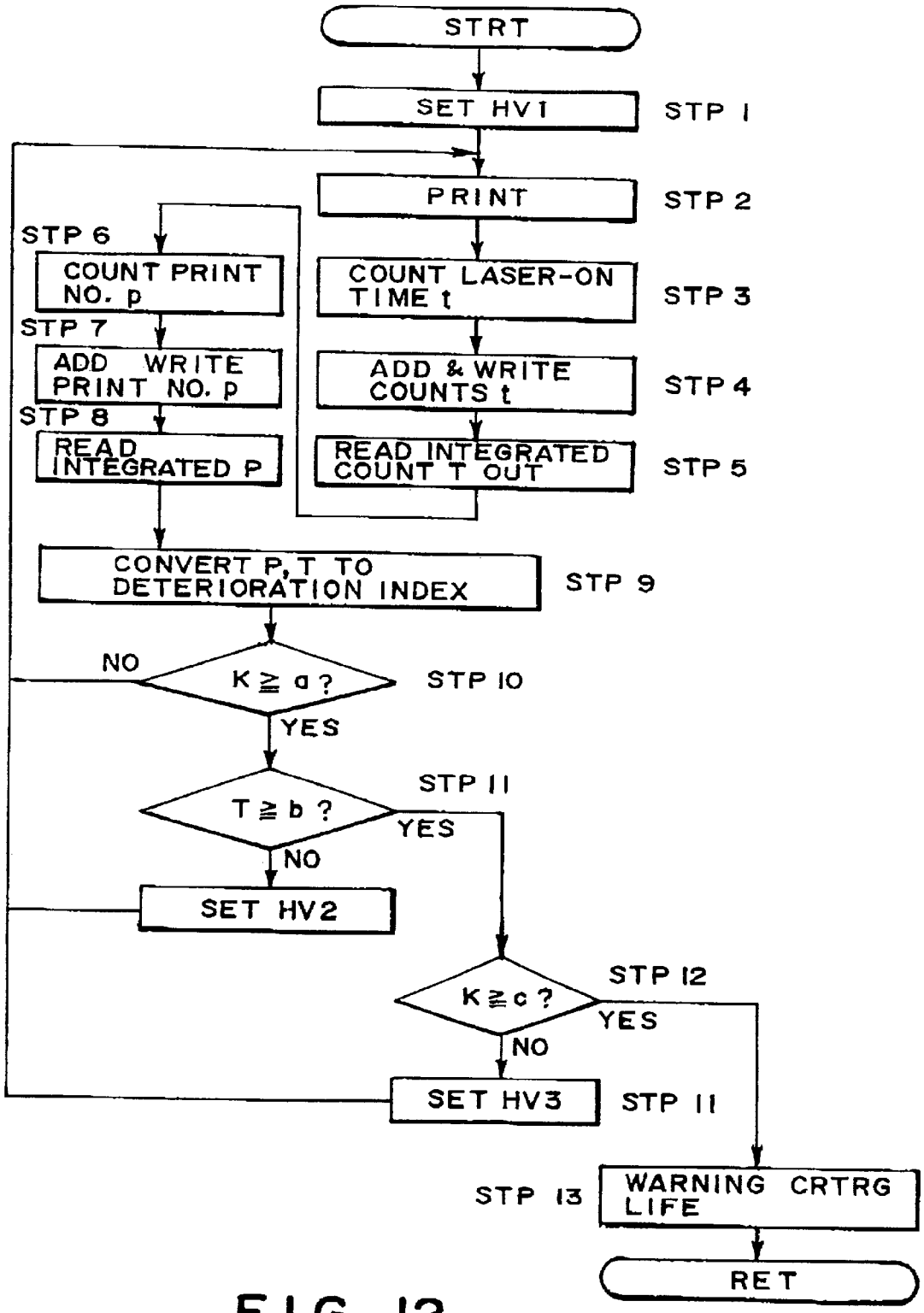
FIG. 12 is a flow chart for describing the operation of the apparatus.

Next, referring to the flow chart in FIG. 12, the flow of the actual image formation by the image forming apparatus in this embodiment will be described.

As a printing operation is initiated, first, the number of clock pulses, that is, clock pulse count t, which concurs with the length of time the laser 21 is kept on, is measured (step 3), and the value of this count t is cumulatively written into the information storing means 60 by the reading/writing means 24 (step 4).

After being written into the information storing means 60, the cumulative value T of the clock pulse count t is read back into the apparatus main assembly 120 (step 5).

Next, the number of prints is counted (step 6), and the print count p is cumulatively written into the information storing means 60 by the reading/writing means 24 (step 7).

After being written into the information storing means 60, the cumulative value P of the print count p is read back into the apparatus main assembly 120 (step 8).

The cumulative count values T and P are converted into an index K, which indicates the degree of the deterioration of the charging device caused by usage, by the converting means 25 (step 9). The thus obtained index K is sequentially compared to the preset values a, b, and c, to determined the high voltage value.

When $T \geqq c$, a user is warned of the expiration of the service life of the cartridge (step 10); it is suggested that the cartridge 100 be replaced.

<Embodiment 5>

Next, referring to FIG. 13, the fifth embodiment of the present invention will be described.

Figure 13:
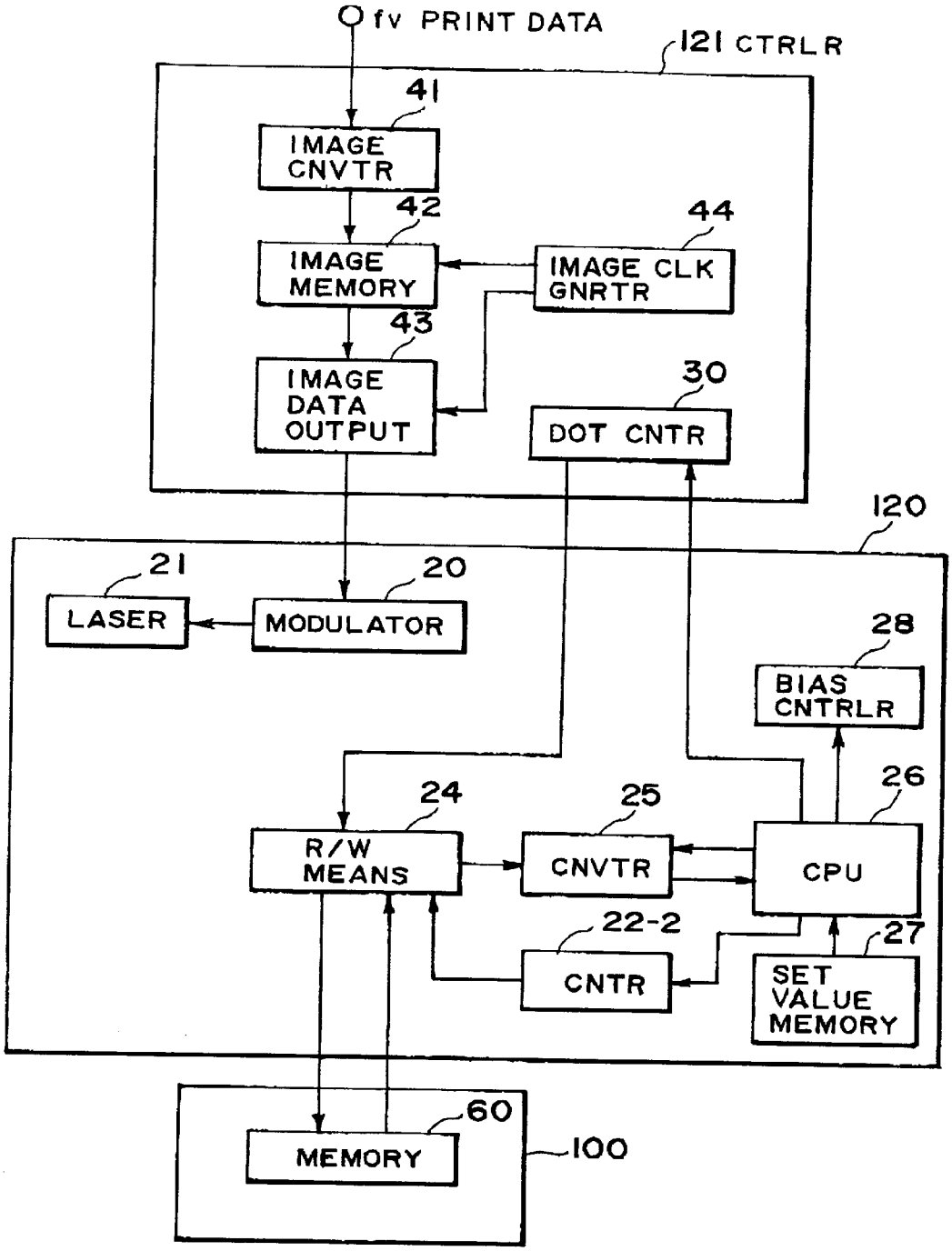
FIG. 13 is a block diagram for describing the operation of the apparatus in the fifth embodiment.

FIG. 13 is an operational block diagram of the image forming apparatus in this embodiment. This embodiment is characterized in that the number of dots which results from the development of the image formation information in the controller 121 is directly counted as the information which concurs with the amount of printing, and the count value is stored in the information storing means 60 within the cartridge 100.

This method of counting the number of printing dots is not compatible with a case in which multivalued image signals are provided by changing the duty ratio of the length of time the laser is kept on as described regarding the first embodiment. However, in the case of this method, all that is necessary is to count the number of dots, which are formed in accordance with the image signals and image clock signals, making it unnecessary to provide an independent clock pulse generating means 23 (FIG. 6) within the apparatus main assembly 120. In other words, this method makes it possible to simplify the circuit structure. Therefore, it is advantageous from the standpoint of cost.

Referring to FIG. 13, a dot counter 30 provided within the controller 121 is a counter for counting the number of dots printed in accordance with the serial image signals and image clock. The serial image signals are outputted by an image data outputting portion 43. The thus obtained printing dot count value is sent to the apparatus main assembly 120, and cumulatively written into the information storing means 60 within the cartridge 100, by the reading/writing means 24, After being written into the information storing means 60, the count value is sent to CPU 26.

Except for the above described feature, this embodiment is identical in structure to the preceding embodiments, and therefore, the detailed description of the other structures of the image forming apparatus in this embodiment will be omitted.

In this embodiment, the number of print dots is counted as the information which concurs with the amount of printing. Therefore, it is possible to simplify the structure of the circuit which controls the bias applied for charging the photosensitive drum 1.

Further, in this embodiment, the dot counter 30 is provided in the controller 121. However, the counter 30 may be provided in the apparatus main assembly 120, and in such a case, the image clock signals are sent to the apparatus main assembly 120.

<Embodiment 6>

Next, the sixth embodiment of the present invention will be described.

This embodiment is characterized in that the length of time bias is applied to eject the toner on the portions other than the image portions is counted as the usage information which concurs with the amount of cartridge usage. The count value is stored in the information storing means 60 within the cartridge 100.

According to the data regarding the relationship between the various image ratios and the decline which occurs as the amount of usage increases, to the potential level to which the charging apparatus is capable of charging the photosensitive drum, the rate of the above described decline of the potential level quickens by approximately 1.36 times, as the ratio of the cumulative amount of printing relative to the cumulative length of the toner ejection time doubles. In this embodiment, therefore, the above described formula (1) for calculating the value of the charging apparatus deterioration index K, has been modified into the following:

$$(T/L)^{0.44}*T=K \quad (2).$$

In the formula (2), the character L stands for cumulative length of time the toner ej ection bias, which is smaller in AC bias amplitude, is applied.

If the sheet interval is different in duration from the post-rotation, the cumulative toner ejection time drastically varies depending on whether the sheets are continually fed or fed with intervals equivalent to the length of a single sheet, even if the image ratio and the number of prints are the same. When the post-rotation is longer in duration than the sheet interval, the more closely an operational mode resembles the aforementioned operational mode with the intervals equivalent to the length of a single sheet, the longer the cumulative toner ejection time, and therefore, the more advantageous an operational mode is in terms of the service life.

In comparison to the cumulative amount of printing, which concurs with the cumulative amount of the toner which has mixed into the charge carrier of the charging apparatus 31, the cumulative length of the time the toner ejection bias is applied coincides with the cumulative length of time the toner is actually ejected. Therefore, the usage of the cumulative length of the toner ejection bias application time as the usage information, instead of the print counts, makes it possible to more accurately estimate the degree of charge carrier deterioration.

In this embodiment, an AC voltage with an amplitude of 300 V is applied in addition to DC bias as the toner ejection bias, during both the sheet intervals and post-rotation. Also, a forced ejection mode is provided, in which as the value of the index K exceeds a preset value, DC bias which is advantageous for the toner ejection is applied for a length of 120 seconds while idling the apparatus, that is, without feeding a sheet.

Figure 14:
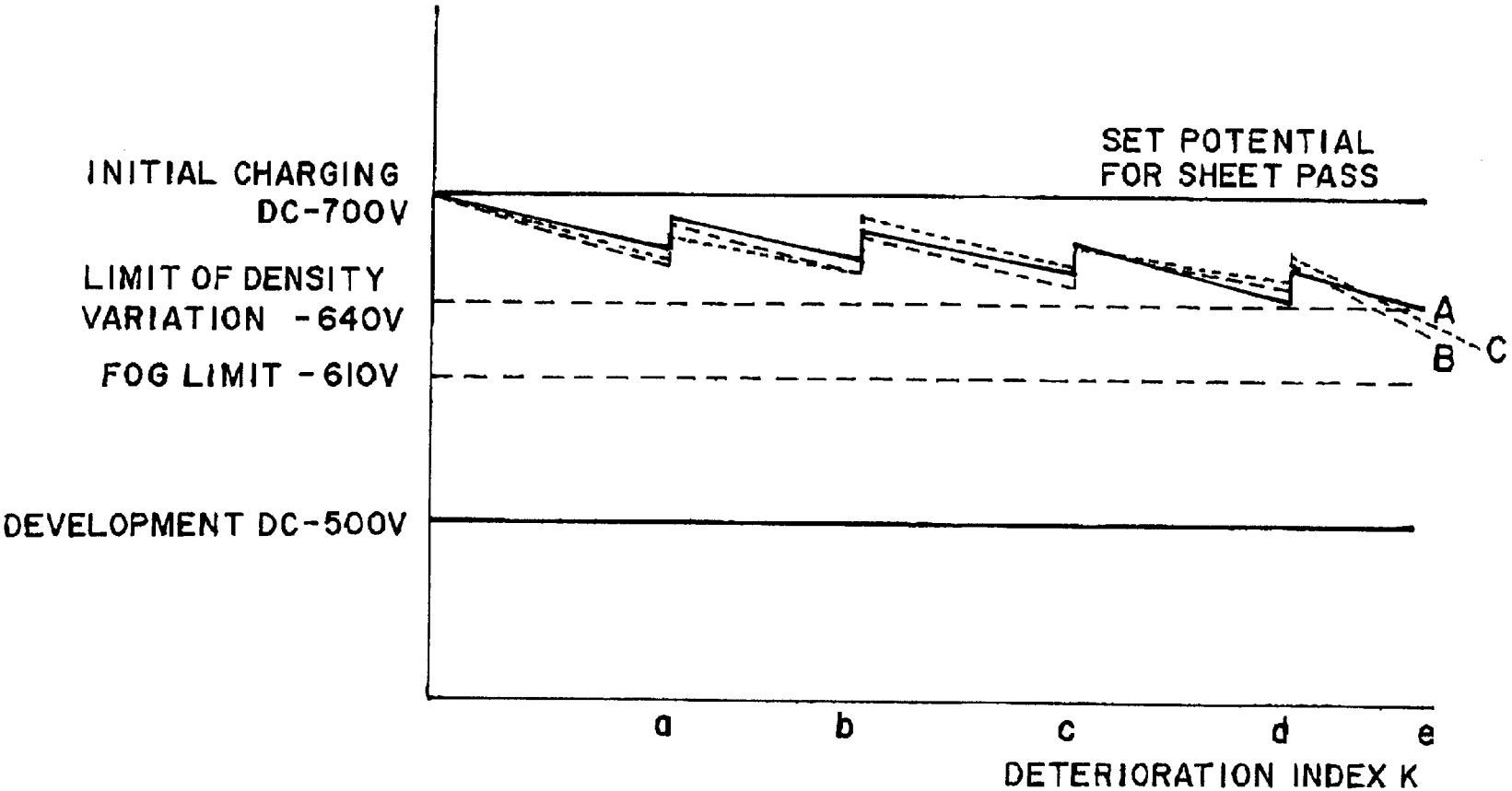
FIG. 14 is a graph for describing the change in the potential level attained by the injection charge which uses a magnetic brush, in the sixth embodiment of the present invention.

FIG. 14 shows the change in the charge bias for the image portion, during the post-rotation and sheet intervals, in this embodiment. The axis of abscissas represents the charging apparatus deterioration index K, and therefore, has no relation to the print count.

In the graph, line A shows the change in the charge potential level of the image portions, in a printing operation in which 1,000 copies of an original with an image ratio of 6%, and 1,000 copies of another original with an image ratio of 20%, are alternately printed, with intervals equivalent to the length of a single sheet of recording medium; line B shows the change in the charge potential level of the image portions, in a printing operation in which 1,000 copies of an original with an image ratio of 6%, and 1,000 copies of another original with an image ratio of 20%, are alternately printed, with intervals equivalent to the combined length of 100 sheets of recording medium; and line C shows the change in the charge potential level of the image portions, in a printing operation in which 1,000 copies of an original with an image ratio of 10%, and 1,000 copies of another original with an image ratio of 15%, are alternately printed, with intervals equivalent to the length of a single sheet of a recording medium.

As is evident from the graph, regardless of image ratio and sheet feeding condition, the charge potential level deteriorates in an approximately similar manner, as far as the conversion index K is concerned.

Each time the forced ejection mode is carried out, the potential level recovered. More specifically, it was possible to prevent the decline of the charge potential level, that is, image quality could be maintained at an excellent level, until the print count reached a value equivalent to approximately 1,000 copies of an original with an image ration of 6%.

<Miscellany>

1) It is apparent that the aforementioned printing amount information, usage information, or change in the charge bias application condition, may be substituted, with the use of various means other than those employed in the preceding embodiments.

2) When an injection charge method is employed, an image bearing member is desired to be provided with a surface layer, the electrical resistance of which is in a range of $10^9$–$10^{14}$ Ω·cm. In other words, it is possible to employ any photosensitive member into which electrical charge can be injected, for example, an OCL photosensitive member, i.e., an OPC photosensitive member provided with a coated surface layer (charge injection layer in which electrically conductive particles such as $SnO_2$ particles are dispersed, or a photosensitive member with a surface layer formed of α-Si (amorphous silicon, noncrystalline silicon). Further, an image bearing member may be of a type that is chargeable primarily through electrical discharge.

3) The selection of a magnetic brush type contact charging apparatus does not need to be limited to the magnetic brush type charging apparatus 31 in the preceding embodiments, which employed a rotational sleeve. In other words, the magnetic brush 35*a* may be moved along the peripheral surface of the nonrotatably fixed charge sleeve 33, by rotating the magnetic roller 34. Also, the surface of the magnetic roller may be processed to give it electrical conductivity so that it can function as a power supply electrode, and magnetic particles are magnetically and directly attached, in the form of a magnetic brush layer, to the peripheral surface of the magnetic roller the charge sleeve 33, so that the magnetic brush is rotationally moved by rotating the magnetic roller. Further, it is possible to employ a magnetic brush type charging apparatus, the magnetic brush of which does not rotate.

The selection of a contact charging means does not need to be limited to a magnetic brush type contact charging means. In other words, a contact charging means other than those described above may be employed; for example, a charge roller type contact charging means, a fur brush type contact charging means, and the like.

4) The wave-form of the AC bias applied to a charging apparatus or a developing apparatus may be sinusoidal, rectangular, triangular, or the like. In other words, the selection of the wave-form is optional, and may be made as is appropriate. Further, the AC bias may be generated by periodically turning on an off a DC power source. In such a case, the wave-form is rectangular. That is, the AC bias may have any wave-form as long as its voltage value periodically changes.

5) The selection of an image exposing means as a means for writing information on the charged surface of the image bearing member in an image forming apparatus does not need to be limited to a laser based digital exposing means such as the one employed in the preceding embodiments. An ordinary analog image exposing means, an image exposing means employing an light emitting element such as an LED, an image exposing means comprising a combination of a light emitting element, such as a fluorescent light, and a liquid crystal shutter, or the like, may be employed. In other words, any image exposing means may be employed as long as it is capable of forming an electrostatic latent image which accurately reflects image information.

6) An image bearing member may be an electrostatically recordable dielectric member. When an image bearing member is an electrostatically recordable dielectric member, the peripheral surface of this dielectric member is uniformly charged (primary charge) to predetermined polarity and potential level, and then, the electrical charge is removed from the selected portions of the peripheral surface of the dielectric member by a charge removing means such as a charge removal needle head, or an electron gun, to write an intended electrostatic latent image.

7) The selection of a method or a means for developing an electrostatic latent image do not need to be limited to the two component contact developing method employed in the preceding embodiments. It may be a single component contact developing method, or a noncontact developing method. Further, it may be a developing method which develops a latent image, in the normal fashion, instead of developing in reversal.

As for the selection of toner, toner produced by pulverization, or toner produced by polymerization, may be employed. Employment of toner produced by polymerization makes it possible to reduce the amount by which the residual toner is generated, and also, makes it possible to satisfactorily recover the transfer residual toner, by a developing means.

8) The selection of a transferring means does not need to be limited to the roller based transferring means employed in the preceding embodiments; a blade based transferring means may be employed. Further, the selection of a charging method for image transfer does not need to be limited to a contact charging method; it may be a noncontact charging method which employs a corona based charging device.

9) The present invention is also applicable to an image forming apparatus which comprises an intermediary transfer member, such as a transfer drum or a transfer belt, and is capable of forming not only monochromatic images, but also multicolor images or a full color images, which are formed through a multilayer transfer process, or the like.

The list of image forming apparatuses to which the present invention is applicable include an image displaying apparatus. An image displaying apparatus comprises, as an image bearing member, an electrophotographic photosensitive member, or an electrostatically recordable dielectric member, which is in the form of a rotatable endless belt, and on which a toner image reflecting relevant image information is formed through the charging process, latent image forming process, and developing process. It is structured so that the range in which the toner image is formed aligns with the display window to enable the toner image to be displayed through the display window. The image bearing member is repeatedly, or endlessly, used for the formation of the images to be displayed.

10) There are such image forming apparatuses that comprise a charging apparatus in the form of a charging unit removably installable in the main assembly of an image forming apparatus. Such a charging unit may be provided with an information storing means, so that the charging unit can be operated in the same manner as the above described process cartridge, to produce the same effects. In this case, each charging apparatus unit is characterized in that it is provided with its own information storing means, and therefore, when a single image forming apparatus is used with a plurality of charging apparatus units, each charging apparatus unit can individually provide the image forming apparatus with its own information regarding the unit condition.

As described above, according to the present invention, which relates to the cleaner-less system for a process cartridge compatible with an image forming apparatus which employs a contact charging method, a cleaner-loss system, and a removably installable process cartridge system, and also relates to an image forming apparatus which employs such a cleaner-less system, it is possible to drastically prolong the service life of the cleaning-less system, which in turn drastically prolongs the service life of a process cartridge without creating a problem. Therefore, it is possible to provide a process cartridge and an image forming apparatus, which are extremely beneficial to a user. In other words, the initial object of the present invention is fully accomplished.

While the invention his been described with reference to the structures disclosed herein, it is not confined to the details set forth, and this application is intended to covet such modifications or changes as may come within the purposes of the improvements or the scope of the following claims.

What is claimed is:

1. An image forming apparatus comprising:

an image bearing member for bearing a toner image:

transfer means for transferring the toner image onto a transfer material from said image bearing member;

charging means for electrically charging said image bearing member, said charging means being effective to collect residual toner remaining on said image bearing member after transfer of the toner image by said transfer means;

voltage application means for applying DC and AC voltages to said charging means, said voltage application means applying a voltage which is effective to return, in an non-image-forming area, the toner collected by said charging means to said image bearing member using an electric field;

image forming means for forming an electrostatic image on said image bearing member charged by said charging means;

developing means for developing the electrostatic image by toner;

integrating means for integrating a degree of usage of said apparatus; and control means for controlling the voltage applied to said charging means;

wherein said control means controls the voltage to be applied to return the collected toner to said image bearing member in accordance with the integrated degree of usage provided by said integrating means.

2. An apparatus according to claim 1, wherein said control means controls the AC voltage.

3. An apparatus according to claim 1, wherein said control means increases the AC voltage with an increase of the integrated degree of usage.

4. An apparatus according to claim 1, wherein the degree of usage includes the number of data printed.

5. An apparatus according to claim 1, wherein the degree of usage includes the number of sheets on which images are formed.

6. An apparatus according to claim 1, wherein at least said image bearing member and said charging means constitute a unit which is detachably mountable to a main assembly of said image forming apparatus, and said unit includes a memory for storing an integrated value provided by said integrating means.

7. An apparatus according to claim 1, wherein said charging means includes a brush for rubbing contact with said image bearing member.

8. An apparatus according to claim 7, wherein the brush is a magnetic brush of magnetic particles.

9. A process cartridge detachably mountable to a main assembly of an image forming apparatus, comprising:

an image bearing member for bearing a toner image;

charging means for effecting injection charging of said image bearing member, said charging means being effective to collect residual toner remaining on said image bearing member after transfer of the toner image and to discharge, in a non-image-forming area, the toner collected thereby back to the image bearing member using an electric field; and memory means for storing data relating to a degree of usage of said process cartridge to be used for a determination of a voltage to be applied for discharging the toner, the voltage being related to power of the injection charging.

10. A process cartridge according to claim 9, wherein the data are a level of an AC voltage to be applied to said charging means.

11. An apparatus according to claim 9, further comprising developing means for developing an electrostatic image on said image bearing member and for collecting residual toner remaining on said image bearing member.

12. An apparatus according to claim 9, wherein the degree of usage includes the number of data printed.

13. An apparatus according to claim 9, wherein the degree of usage includes a number of sheets on which images are formed.

14. An apparatus according to claim 9, wherein at least said image bearing member and said charging means constitute a unit which is detachably mountable to a main assembly of said image forming apparatus, and said unit includes a memory for storing an integrated value provided by integrating means.

15. An apparatus according to claim 9, wherein said charging means includes a brush for rubbing contact with said image bearing member.

* * * * *

UNITED STATES PATENT AND TRADEMARK OFFICE

CERTIFICATE OF CORRECTION

PATENT NO. : 6,324,357 B1
DATED : November 27, 2001
INVENTOR(S) : Fumiteru Gomi et al.

It is certified that error appears in the above-identified patent and that said Letters Patent is hereby corrected as shown below:

Column 11,
Line 61, “portion” should read -- portion. --.

Column 15,
Line 9, “an” should read -- a --.

Column 16,
Line 24, “T<c,” should read -- T≥c, --.

Column 19,
Line 37, “satisfieds” should read -- satisfies --.

Column 22,
Line 53, “an” should read -- and --.

Signed and Sealed this

Fifteenth Day of October, 2002

*Attest:*

*Attesting Officer*

JAMES E. ROGAN
*Director of the United States Patent and Trademark Office*